US006805342B2

(12) United States Patent
Takahara et al.

(10) Patent No.: US 6,805,342 B2
(45) Date of Patent: Oct. 19, 2004

(54) PRINTER-CONTROL METHOD AND PRINTER-CONTROL APPARATUS

(75) Inventors: Toshiyuki Takahara, Nagano-Ken (JP); Tetsuji Takeishi, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 47 days.

(21) Appl. No.: 10/287,767

(22) Filed: Nov. 5, 2002

(65) Prior Publication Data

US 2003/0085513 A1 May 8, 2003

(30) Foreign Application Priority Data

Nov. 8, 2001 (JP) ..... 2001-343384

(51) Int. Cl.[7] ..... B65H 7/02; B65H 7/00; B65H 9/04; B65H 9/00; B65H 3/06

(52) U.S. Cl. ..... 271/19; 221/110; 221/242; 221/202; 221/258.01

(58) Field of Search ..... 271/19, 33, 21, 271/110, 119, 226, 242, 256, 258.01, 3.13, 202

(56) References Cited

U.S. PATENT DOCUMENTS 5,482,265 A * 1/1996 Nakazato et al. ..... 271/242
5,543,909 A * 8/1996 Quesnel ..... 399/394
5,678,488 A * 10/1997 Yamaguchi et al. ..... 101/438
5,738,349 A * 4/1998 Shirasaki ..... 271/242

FOREIGN PATENT DOCUMENTS

JP 2001-270203 * 10/2001 ..... B41J/29/46

* cited by examiner

*Primary Examiner*—Ronald T. Walsh
*Assistant Examiner*—Kenneth W. Bowers
(74) *Attorney, Agent, or Firm*—Sughrue Mion, PLLC

(57) ABSTRACT

In accordance with printer-control method and printer-control apparatus according to the present invention, in speed control for a paper-supply motor from the time when a paper-supply roller starts a paper-supply operation to the time when an upper end of a printing paper abuts against a paper-feed roller and a driven roller thereof and then the paper-supply motor is stopped with the upper end portion of the printing paper being nipped by the paper-feed roller and the driven roller thereof, when a difference between a target speed and a current speed in a constant speed section under feedback control becomes equal to or larger than a predetermined value, a proportional gain coefficient used for speed control calculation is changed to a value which is larger than an usual value.

7 Claims, 16 Drawing Sheets

PRINTER-CONTROL METHOD AND PRINTER-CONTROL APPARATUS

BACKGROUND OF THE INVENTION

1. Field of the Invention

The present invention relates to a printer-control method and a printer-control apparatus, and in particular, to a printer-control method and a printer-control apparatus that in a paper-supply operation into a printer, speed control of a paper-supply motor is performed when a printing paper abuts against a paper-feed roller and a driven roller and is nipped by them. Further, the present invention relates to a storage medium which stores a computer program for executing the printer-control method.

2. Related Background Art

FIG. 1 is an explanatory illustration typically showing structures of components that relate to paper-supply of printing paper and detection of upper and lower ends of the printing paper in a printer.

In the printer, as shown in FIG. 1, printing papers 50 that are set in a tray 90 are fed one by one by a paper-supply roller 64. Then, an upper end of the printing paper 50 is detected by a paper sensor 15. A paper-supply motor 63 (see FIG. 10) is coupled to the paper-supply roller 64. The paper-supply roller 64 is driven by driving and controlling the paper-supply motor 63 and thus the paper is supplied into the printer.

Then, the printing paper 50 is fed by a paper-feed roller 65 and a driven roller 66. Printing is performed on a platen 84 by an ink discharged from a printhead 9. Printing advances to a vicinity of a lower end of the printing paper 50 while the printing paper 50 is successively fed. The printing paper 50 does not exist on the paper sensor 15 at a certain time. In this way, the lower end of the printing paper 50 is detected.

An operation of supplying a printing paper into a printer is generally performed as described above. In the paper-supply operation, when a printing paper abuts against a paper-feed roller and a driven roller and is nipped therebetween, i.e., at a time of so-called abutting and nipping, the upper end of the printing paper is desirably nipped between the paper-feed roller and the driven roller so as to be parallel to them.

In actuality, however, when the printing paper abuts the paper-feed roller and the driven roller and is nipped therebetween, the upper end of the printing paper is not perfectly parallel to the paper-feed roller and the driven roller. The upper end of the printing paper is often nipped while slightly inclined.

Then, after the printing paper is nipped, the printing paper which is nipped by the paper-feed roller and the driven roller is fed in a reverse direction and pushed back, i.e., discharging of the printing paper is performed. By repeating such nipping and discharging for several times, the upper end of the printing paper is perfectly parallel to the paper-feed roller and the driven roller. In this way, deskew of the printing paper is performed. Deskew operation of printing paper will be hereinafter described in detail with reference to the drawings.

FIGS. 2A through 2E are explanatory illustrations typically showing states of the paper-supply roller, the paper-feed roller and the printing paper in deskew of the printing paper, seen from the side. FIGS. 3A through 3E are explanatory illustrations typically showing states of the paper-supply roller, the paper-feed roller and the printing paper in deskew of the printing paper, seen from above.

As shown in FIGS. 2A and 3A, when each printing paper 50 is fed by the paper-supply roller 64 one by one, in accordance with rotational operation of the paper-supply roller 64, an upper end of the printing paper 50 gradually approaches the paper-feed roller 65 and the driven roller 66. At this time, the upper end of the printing paper 50 is desirably parallel to the paper-feed roller 65 and the driven roller 66. As shown in FIG. 3A, however, the upper end of the printing paper 50 may be inclined with respect to the paper-feed roller and the driven roller.

As shown in FIGS. 2B and 3B, when the paper-supply roller 64 is further rotated, the upper end portion of the printing paper 50 abuts against the paper-feed roller 65 and the driven roller 66 and is nipped therebetween. As described above, such state is referred to as nipping of the printing paper.

The paper-supply roller 64 is rotated by a predetermined amount and then stopped in order to deskew the printing paper. At this time, a length of the upper end portion of the printing paper which is extended off from the position at which the printing paper 50 is nipped by the paper-feed roller 65 and the driven roller 66 toward the printer is referred to as a nipping amount C. The nipping amount C is usually set for each type of the printing paper 50 and can be changed by setting a printer corresponding to the type of the printing paper 50. Referring to FIGS. 2B and 3B, the state in which the printing paper 50 abuts against the paper-feed roller 65 and the driven roller 66 while being inclined is shown. Thus, the nipping amount C shows a nipping amount at a generally central portion of the printing paper 50.

Then, as shown in FIGS. 2C and 3C, in order to deskew the printing paper 50, the paper-feed roller 65 is rotated in reverse while the paper-supply roller 64 is stopped. The printing paper 50 is fed in reverse by the nipping amount C and thus discharged. The printing paper 50 which is fed in reverse by the nipping amount C and discharged is deflected. Further, the upper end of the printing paper 50 is forcibly abutted against the paper-feed roller 65 and the driven roller 66 because of flexibility of the printing paper itself. At this time, the upper end of the printing paper 50 is generally parallel to the paper-feed roller 65 and the driven roller 66.

When the upper end of the printing paper 50 is generally parallel to the paper-feed roller 65 and the driven roller 66, as shown in FIGS. 2D and 3D, the paper-feed roller 65 is rotated forward within a range of the nipping amount C, so that the upper end of the printing paper 50 is nipped by the paper-feed roller 65 and the driven roller 66. Then, by repeating nipping shown in FIGS. 2D and 3D and discharging shown in FIGS. 2C and 3C for several times, the upper end of the printing paper 50 becomes parallel to the paper-feed roller 65 and the driven roller 66.

When the upper end of the printing paper 50 becomes parallel to the paper-feed roller 65 and the driven roller 66, the paper-feed roller 65 is rotated forward and the printing paper 50 is nipped again by the paper-feed roller 65 and the driven roller 66. Further, the paper-supply roller 64 is rotated such that the printing paper 50 is released. Thereafter, subsequent paper-feed operation is performed. In this way, deskew of printing paper is performed.

Next, a description will be given about speed control of the paper-supply motor from the time when a paper-supply roller starts a paper-supply operation to the time when the paper-supply roller is stopped to deskew a printing paper.

FIG. 4 is a graph showing a first example of target speed, current speed and waveform of control signal for the paper-supply motor from the time when a paper-supply roller starts a paper-supply operation to the time when the paper-supply roller is stopped in order to deskew a printing paper. FIG. 5 is a graph showing a section from 300 to 0 of remaining distance to a target stop position shown in FIG. 4 with only a horizontal axis being enlarged.

The target stop position shown in FIGS. 4 and 5 show a position at which an upper end of printing paper is nipped by the paper-feed roller 65 and the driven roller 66 by a predetermined nipping amount C and the paper-supply roller 64 is stopped in order to deskew the printing paper.

At a section from 800 (1/1440 inches (1 inch=2.54 cm): a unit will be appropriately omitted hereinafter) to 700 of remaining distance to the target stop position, a PID waveform is shown. Nevertheless, this section is not a PID control section but an acceleration control section. At the section, acceleration toward a target speed Vref in a constant speed section from 700 to 300 of remaining distance is performed.

In the constant speed section from 700 to 300 of remaining distance, PID control starts. Thereafter, the PID control is performed until the paper-supply motor is stopped in order to stop the paper-supply roller 64 at the target stop position. At the constant speed section, the PID control is performed so as to converge undershoot and overshoot of current speed Vcur relative to the target speed Vref.

Speed reduction control of the target speed Vref gradually starts at the remaining distance of about 300 and more rapid speed reduction control is performed from 200 of remaining distance.

Undershoot of the current speed Vcur occurs at 200 to 100 of remaining distance in the speed reduction control section. This is because the upper end of printing paper abuts the paper-feed roller 65 and the driven roller 66 and thus the current speed Vcur is temporarily and rapidly reduced.

Since the PID control is performed at the speed reduction control section, in order to reduce a difference between the target speed Vref and the current speed Vcur in an undershoot section, a PID command value for instructing acceleration is outputted.

However, while the paper-supply motor is accelerated in accordance with the PID command value, the target speed Verf is reducing. Thus, overshoot of the current speed Vcur occurs at a section from 100 to 20 of remaining distance by contraries.

Then, in order to reduce a difference between the target speed Vref and the current speed Vcur in the overshoot section, a PID command value for instructing reduction in speed is outputted by the PID control.

As a result, although overshoot of the current speed Vcur is converged at around 20 of remaining distance, undershoot of the current speed Vcur occurs again at a section from 20 to 5 of remaining distance.

In order to reduce a difference between the target speed Vref and the current speed Vcur in the undershoot section, a PID command value for instructing acceleration is outputted and thus the current speed Vcur generally coincides the target speed Vref. Then, a PID command value for instructing reduction in speed in accordance with the target speed Vref is outputted. At the target stop position, the current speed Vcur becomes 0 and the paper-supply motor and the paper-supply roller stop.

For control of the current speed Vcur of the paper-supply motor under the above-described PID control, output pulses of two phases, i.e., A phase and B phase of encoder are used. Nevertheless, both output pulses of two phases of the encoder are not always used but used depending on a control section. Namely, in the constant speed section from 700 to 300 of remaining distance, because a speed of motor is sufficiently high, both output pulses of two phases of encoder are not required. For example, only a rising edge of output pulse of A phase of the encoder is used and an interruption of speed control calculation is generated. In the speed reduction section from 300 to 0 of remaining distance, a speed of motor is reduced toward 0 and more precise speed control is required. Thus, an interruption of speed control calculation is generated by using rising and falling edges of each of the output pulses of A phase and B phase of the encoder.

Setting of proportional gain coefficient used for speed control calculation under PID control in the constant speed section is usually different from that of the speed reduction section. If the proportional gain coefficient is set to be too large in the constant speed section, vibration and unpleasant noise are often generated due to resonance of a driving force transmitting mechanism. Thus, the proportional gain coefficient is set to be relatively so small that generation of vibration and unpleasant noise is prevented. On the other hand, the proportional gain coefficient is set, in an ordinary state, to be the same as in the constant speed section because of the same reason. Nevertheless, in the speed reduction section, as undershoot and overshoot due to abutment of printing paper occur, a variation in speed that is more sever than that of the constant speed section must be rapidly converged. Accordingly, if a difference between the target speed Vref and the current speed Vcur exceeds a predetermined threshold, the proportional gain coefficient is set to be changed to a larger value than an usual value.

Speed control of the paper-supply motor from the time when a paper-supply roller starts a paper-supply operation to the time when the paper-supply roller is stopped in order to deskew a printing paper is described above. Timings that undershoot and overshoot of current speed Vcur are generated by an upper end of printing paper abutting against the paper-feed roller 65 and the driven roller 66 are varied depending on a set value of the nipping amount C of printing paper. A size or a duration of the undershoot and the overshoot is varied depending on a type of the printing paper or an angle of the upper end of the printing paper with respect to the paper-feed roller and the driven roller.

When the upper end of the printing paper abuts against the paper-feed roller 65 and the driven roller 66 at the speed reduction section, a proportional gain coefficient used for speed control calculation is changed to a larger value in accordance with generation of undershoot of the current speed Vcur with respect to the target speed Vref. Thus, undershoot and overshoot due to abutment of the printing paper can be usually converged such that problems do not occur at subsequent operations.

When an initial nipping amount C at a time of deskew operation for printing paper is set to be large, the upper end of the printing paper may abut against the paper-feed roller 65 and the driven roller 66 at the constant speed section.

A proportional gain coefficient used for speed control calculation in the constant speed section is determined by presupposing that a variation width of the current speed Vcur is small. Further, the proportional gain coefficient is always set to be a relatively small certain value in order to prevent generation of aforementioned vibration and unpleasant noise. The proportional gain coefficient is not changed to a value larger than an usual value regardless of a difference between the target speed Vref and the current speed Vcur.

Accordingly, in the case where abutment of printing paper occurs at the constant speed section, undershoot and overshoot of the current speed Vcur with respect to the target speed Vref caused by abutment of the printing paper cannot be converged such that problems do not occur at subsequent operations. There arises a problem in that depending on a size or a duration of undershoot and overshoot, the current speed Vcur may become 0 before reaching the target stop position, and the paper-supply motor and a printing paper stop on their ways. As a result, subsequent deskew operation for printing paper may be hindered.

SUMMARY OF THE INVENTION

An object of the present invention is to provide a printer-control method and a printer-control apparatus that are configured such that in speed control of the paper-supply motor from the time when a paper-supply roller starts a paper-supply operation to the time when the paper-supply roller is stopped in order to deskew a printing paper, i.e., to the time when the paper-supply roller is stopped while an upper end portion of the printing paper is nipped by a paper-feed roller and a driven roller thereof, undershoot and overshoot of speed waveform of the paper-supply motor caused by abutment of the upper end of the printing paper against the paper-feed roller and the driven roller can be converged as soon as possible and stop of the printing paper on its way caused by such undershoot and overshoot can be prevented.

According to the printer-control method of the present invention, there is provided with a printer-control method in speed control for a paper-supply motor from the time when a paper-supply roller starts a paper-supply operation to the time when an upper end of a printing paper abuts against a paper-feed roller and a driven roller thereof and then the paper-supply motor is stopped with the upper end portion of the printing paper being nipped by the paper-feed roller and the driven roller thereof, when a difference between a target speed and a current speed in a constant speed section under feedback control becomes equal to or larger than a predetermined value, a proportional gain coefficient used for speed control calculation is changed to a value which is larger than an usual value.

In the above configuration of the printer-control method according to the present invention, control for changing the proportional gain coefficient can be performed on the condition that a nipping amount of the printing paper with respect to the paper-feed roller and the driven roller thereof at a target stop position at which the paper-supply motor is stopped with the upper end portion of the printing paper being nipped by the paper-feed roller and the driven roller thereof is set to be equal to or larger than a predetermined value.

According to the printer-control apparatus of the present invention, there is provided with a printer-control apparatus comprising a feedback control component which changes a proportional gain coefficient used for speed control calculation to a value which is larger than an usual value when a difference between a target speed and a current speed in a constant speed section under feedback control becomes equal to or larger than a predetermined value in speed control for the paper-supply motor from the time when a paper-supply roller starts a paper-supply operation to the time when an upper end of a printing paper abuts against a paper-feed roller and a driven roller thereof and then the paper-supply motor is stopped with an upper end portion of the printing paper being nipped by the paper-feed roller and the driven roller thereof.

In the above configuration of the printer-control apparatus according to the present invention, the feedback control component can perform control for changing the proportional gain coefficient on the condition that a nipping amount of the printing paper with respect to the paper-feed roller and the driven roller thereof at a target stop position at which the paper-supply motor is stopped with the upper end portion of the printing paper being nipped by the paper-feed roller and the driven roller thereof is set to be equal to or larger than a predetermined value.

Furthermore, in the above configuration of the printer-control method and the printer-control apparatus according to the present invention, the predetermined value of the nipping amount is a minimum value of the nipping amount in the case where the printing paper abuts against the paper-feed roller and the driven roller thereof in the constant speed section under feedback control.

In accordance with a printer-control method and a printer-control apparatus according to the present invention, because of the above-described structure, undershoot and overshoot of current speed relative to target speed due to abutment of upper end of printing paper against a paper-feed roller and a driven roller thereof can be rapidly and appropriately converged. As a result, it is possible to prevent the printing paper from stopping on its way caused by such undershoot and overshoot.

A storage medium according to the present invention stores a computer program for executing any of the printer-control methods of the present invention on a computer system.

DESCRIPTION OF THE PREFERRED EMBODIMENTS

Disclosed first are an overview of an inkjet printer and a method of controlling the inkjet printer, the main target of the printer-control apparatus and method according to the present invention to be applied.

Figure 1:
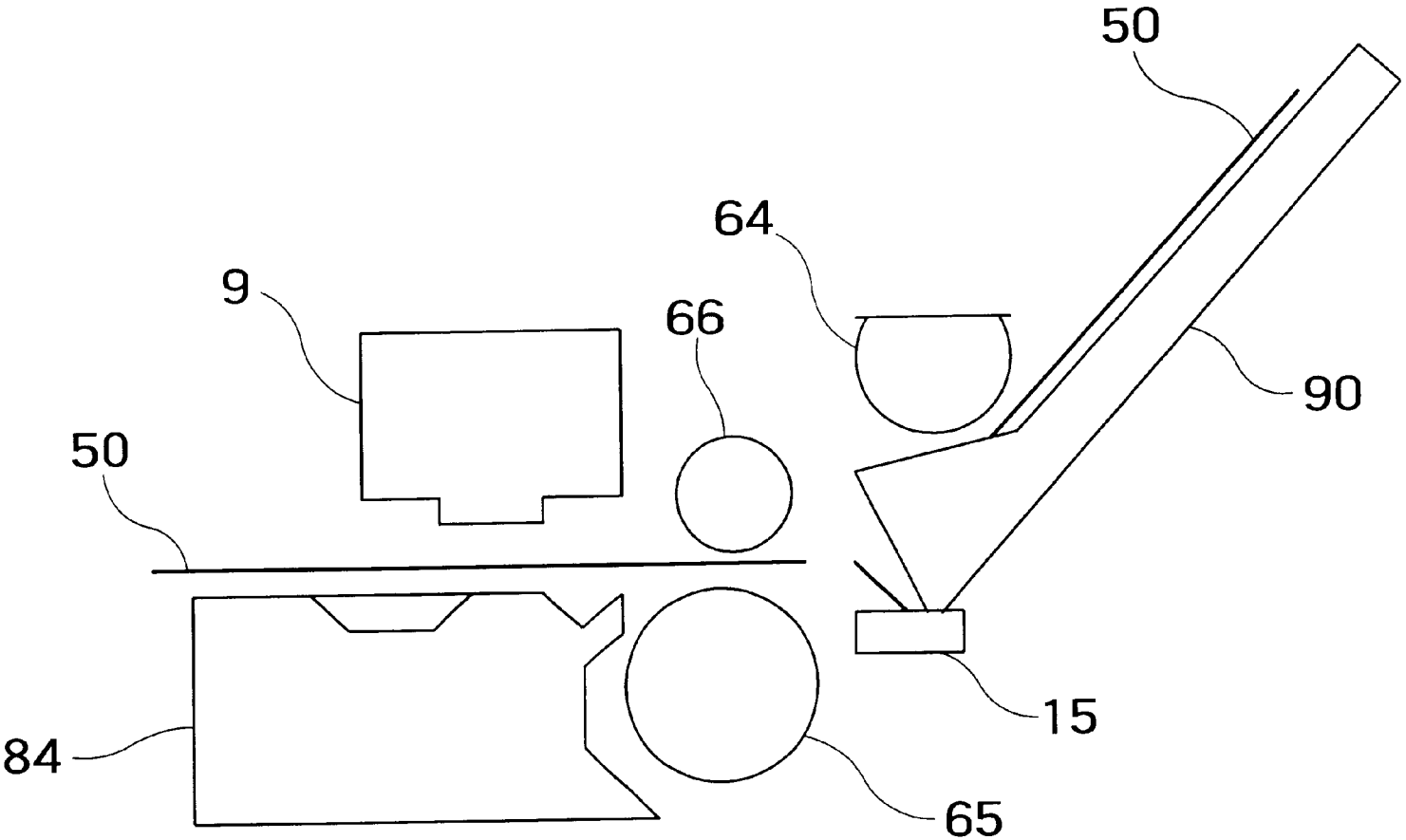
FIG. 1 is an explanatory illustration typically showing structures of components that relate to paper-supply of printing paper and detection of upper and lower ends of the printing paper in a printer.
Figure 2A:
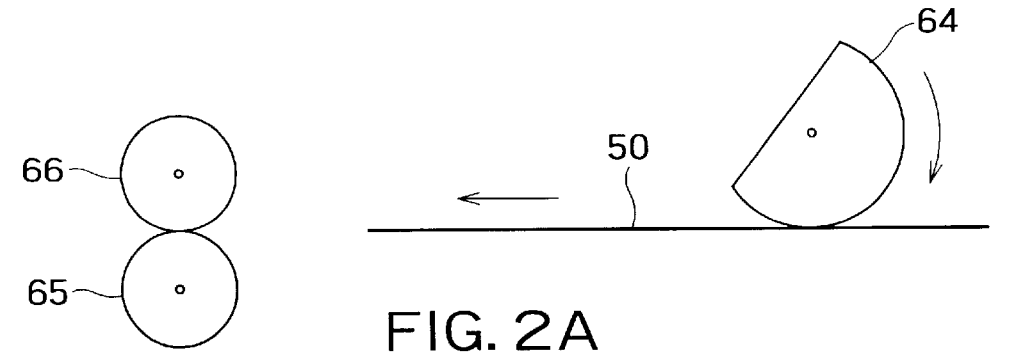
FIGS. 2A through 2E are explanatory illustrations typically showing states of the paper-supply roller, the paper-feed roller and the printing paper at a time of deskew of the printing paper, seen from the side.
Figure 2B:
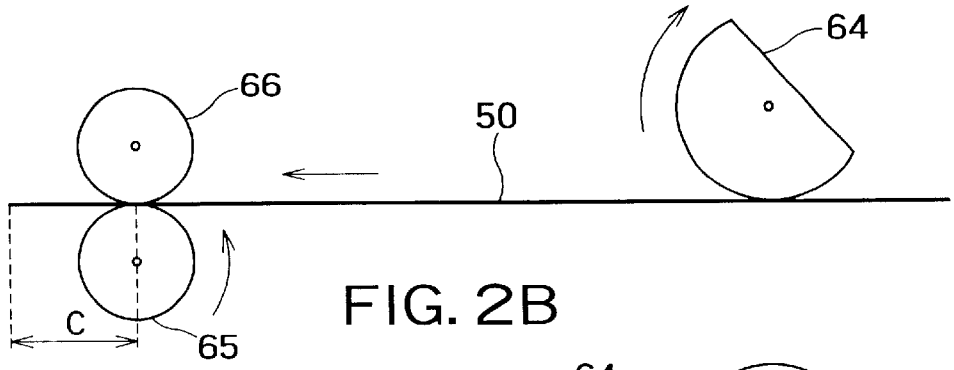
Figure 2C:
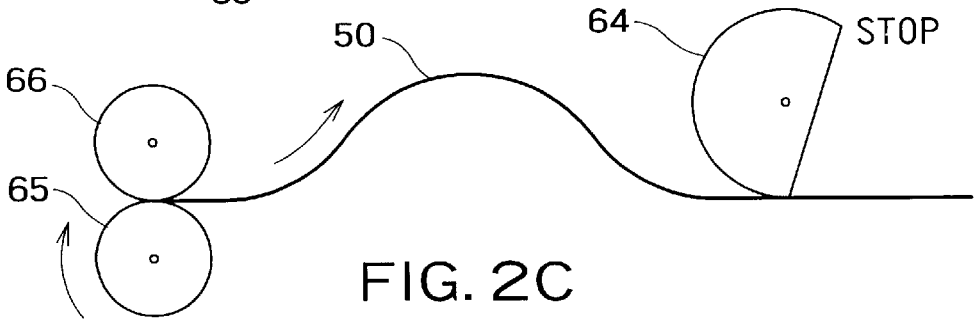
Figure 2D:
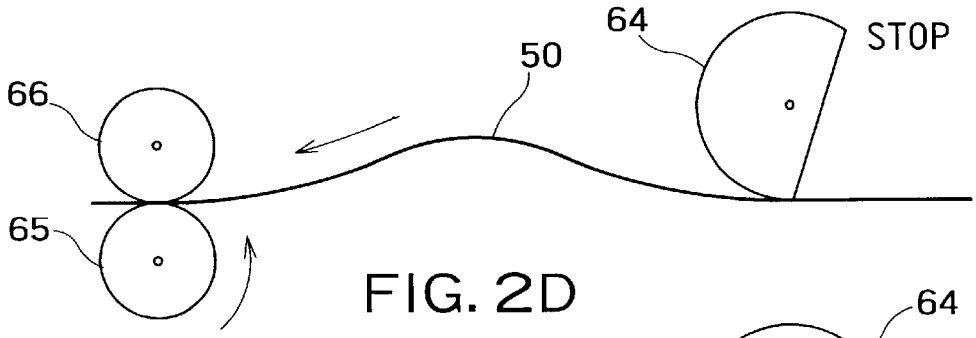
Figure 2E:
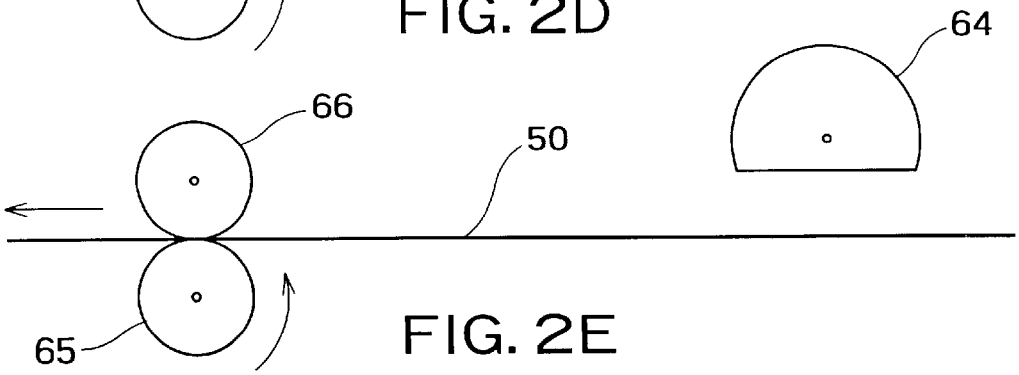
Figure 3A:
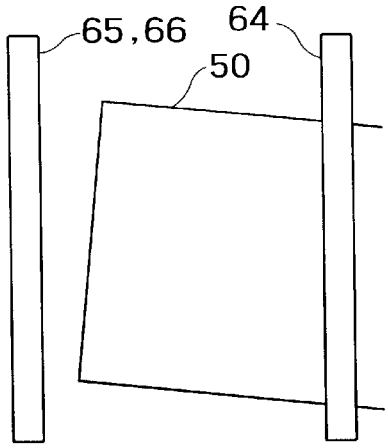
FIGS. 3A through 3E are explanatory illustrations typically showing states of the paper-supply roller, the paper-feed roller and the printing paper at the time of deskew of the printing paper, seen from above.
Figure 3D:
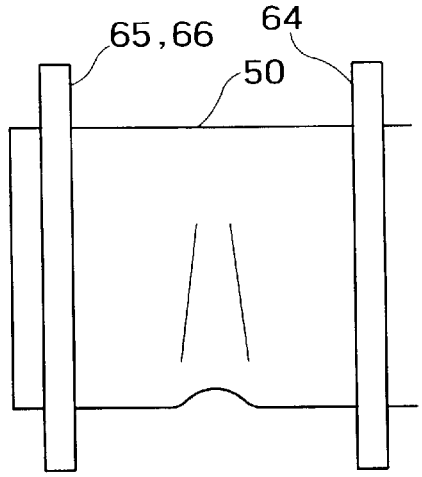
Figure 3B:
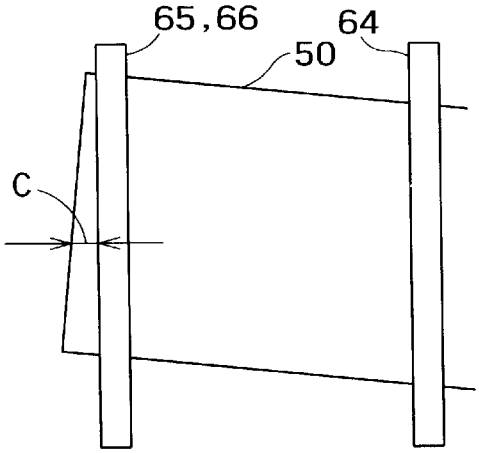
Figure 3E:
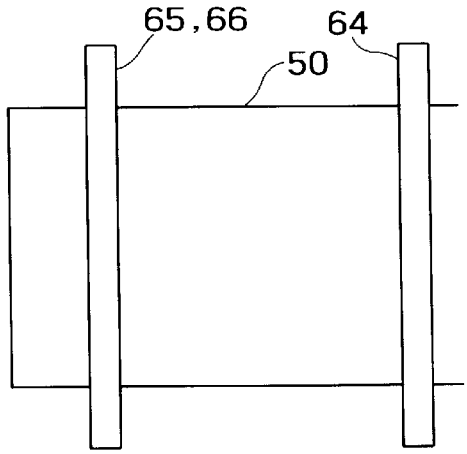
Figure 3C:
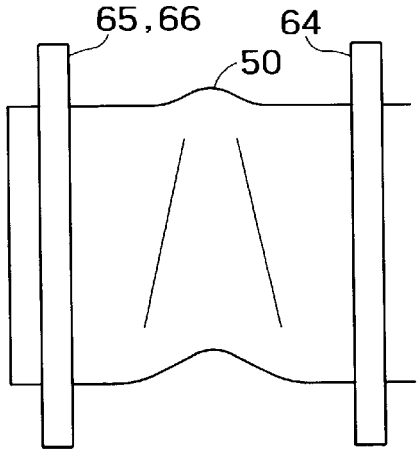
Figure 4:
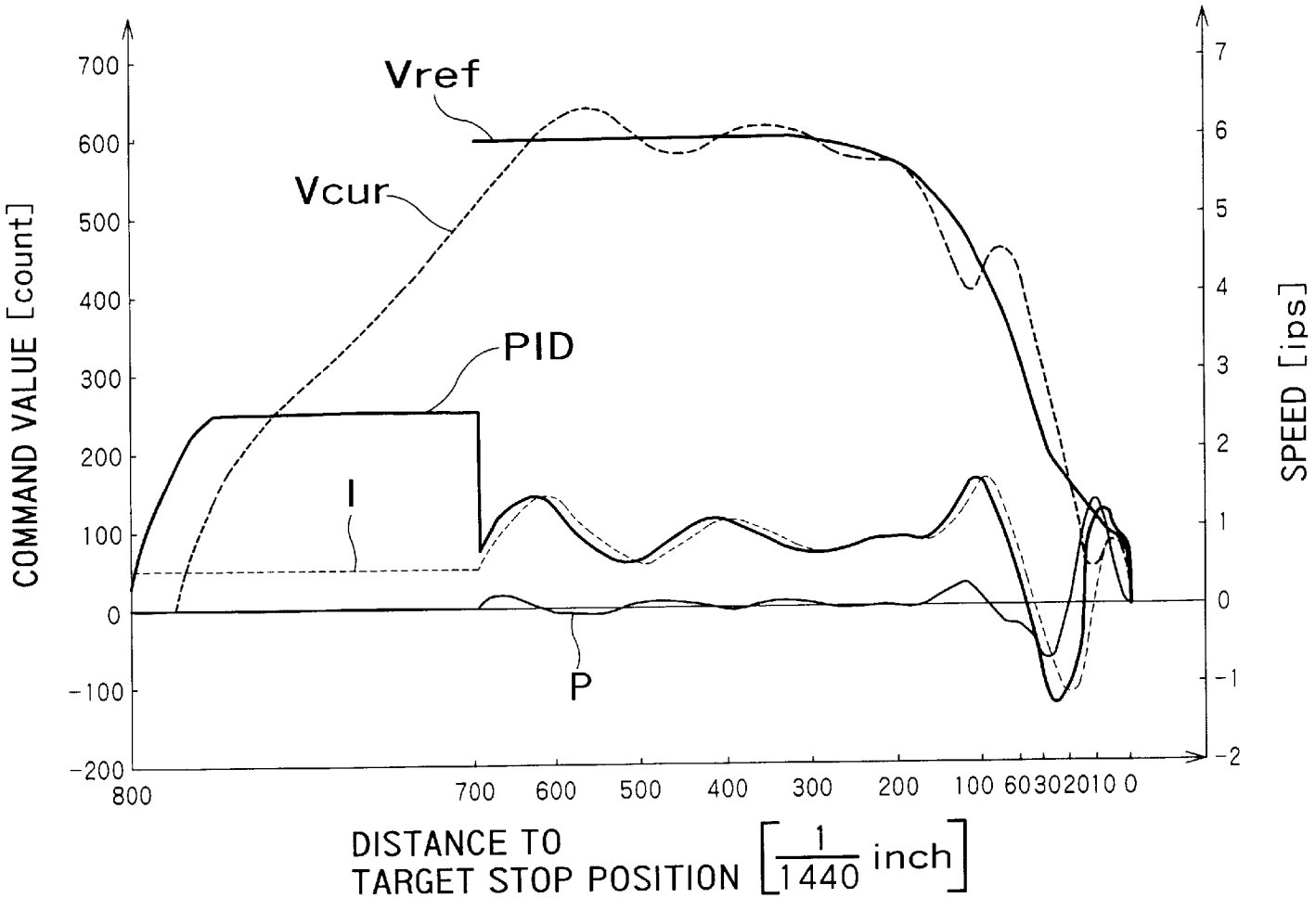
FIG. 4 is a graph showing a first example of target speed, current speed and waveform of control signal for a paper-supply motor from the time when the paper-supply roller starts a paper-supply operation to the time when the paper-supply roller is stopped in order to deskew a printing paper.
Figure 5:
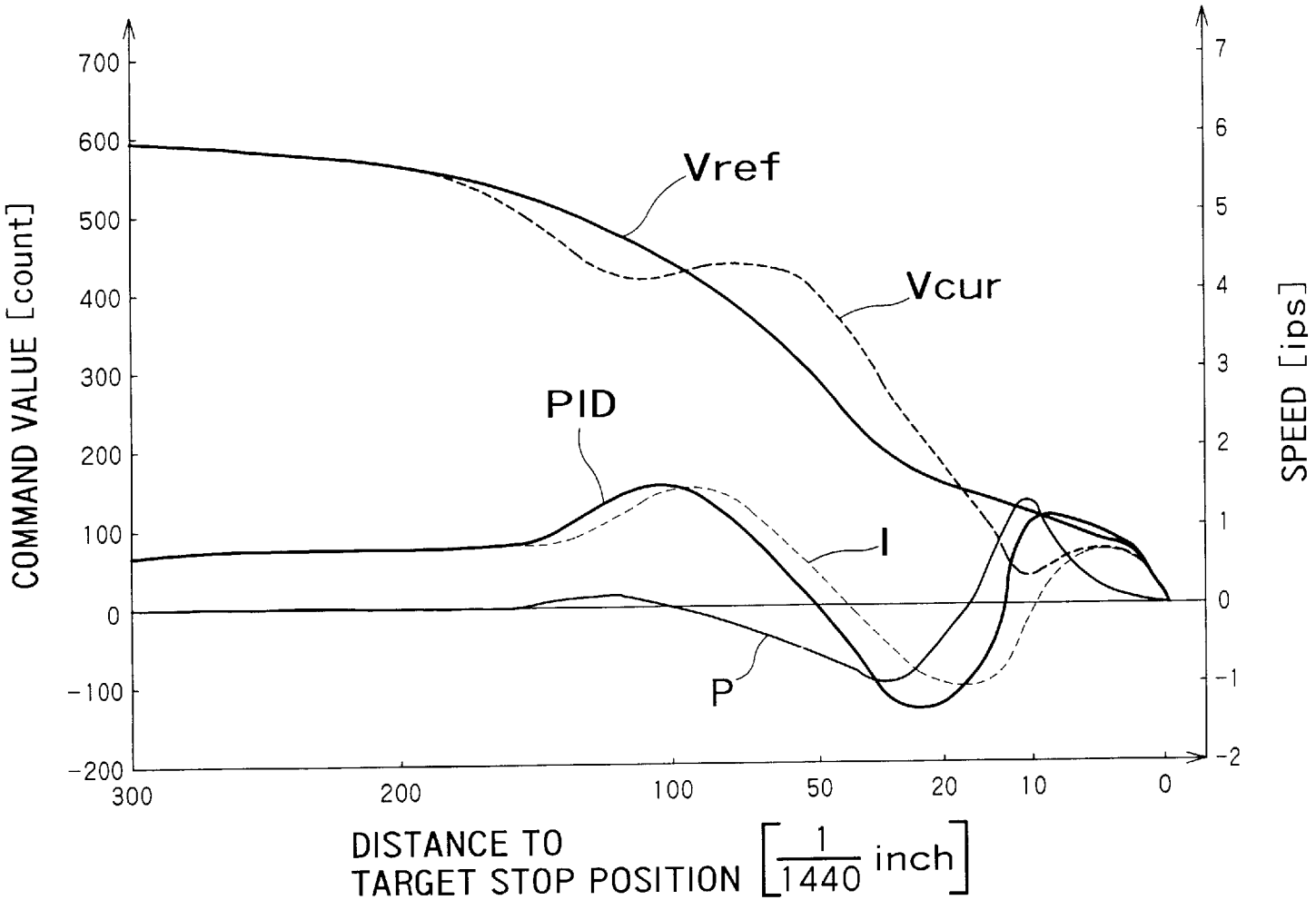
FIG. 5 is a graph of section from 300 to 0 of remaining distance to a target stop position shown in FIG. 4 with only horizontal axis being enlarged.
Figure 6:
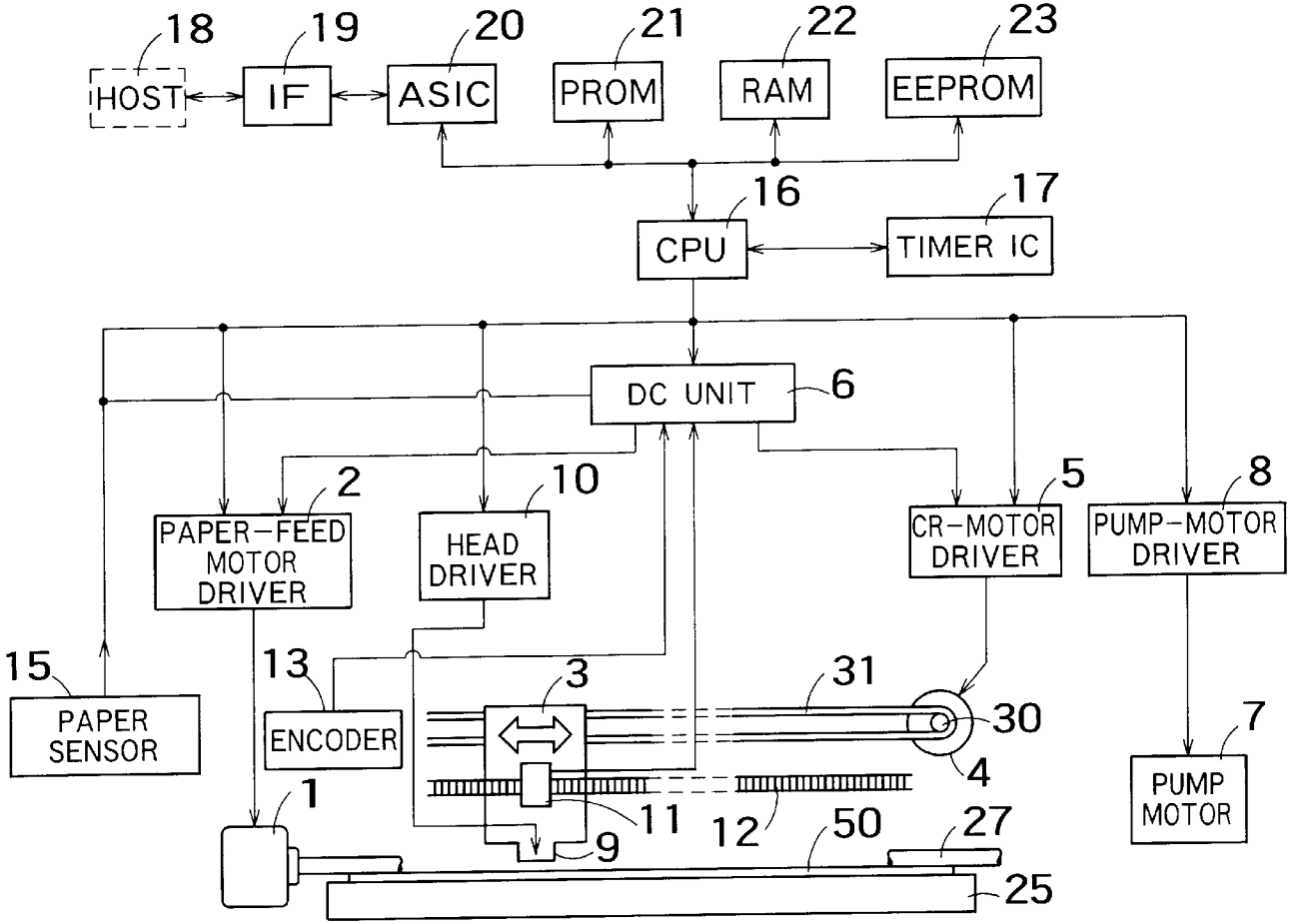
FIG. 6 is a block diagram showing an overview of an inkjet printer.

FIG. 6 is a block diagram showing an overview of an inkjet printer;

The inkjet printer is equipped with the following components: a paper-feed motor (termed as PF motor occasionally) 1 for paper feeding; a paper-feed motor driver 2 for driving the paper-feed motor 1; a carriage 3 having a head 9 for discharging ink onto a printing paper 50, the carriage 3 being driven in directions horizontal to the printing paper 50 and orthogonal to a paper-feed direction; a carriage motor (termed as CR motor occasionally) 4 for driving the carriage 3; a CR-motor driver 5 for driving the carriage motor 4; a DC unit 6 for supplying a direct-current command value to the CR-motor driver 5; a pump motor 7 for controlling suction of ink to protect the head 9 from being plugged up with dried ink; a pump-motor driver 8 for driving the pump motor 7; a head driver 10 for driving the head 9; a linear encoder 11 fixed on the carriage 3; a code disk 12 having slits formed per a specific interval, incorporated in the linear encoder 11; a rotary encoder 13 to be used for the PF motor 1; a paper sensor 15 for detecting the end of a printing paper under printing process; a CPU 16 for overall control to the printer; a timer IC 17 for periodically generating interrupting signals to the CPU 16; an interface (termed as IF occasionally) 19 for data communications with a host computer 18; an ASIC 20 for controlling printing resolution, driving waveforms, and so on, based on printing information sent from the host computer 18 via the IF 19; a PPROM, a RAM 22 and an EEPROM 23 to be used as working and/or program-storing areas for the ASIC 20 and CPU 16; a platen 25 for supporting the printing paper 50; a transfer roller 27 to be driven by the PF motor 1 for transferring the printing paper 50; a pulley 30 fixed on a rotary shaft of the CR motor 4; and a timing belt 31 to be driven by the pulley 30.

The DC unit 6 drives the paper-feed motor driver 2 and the CR-motor driver 5 based on a control command sent from the CPU 16 and the output of the encoders 11 and 13. The paper-feed motor 1 and the CR motor 4 are a DC motor.

Figure 7:
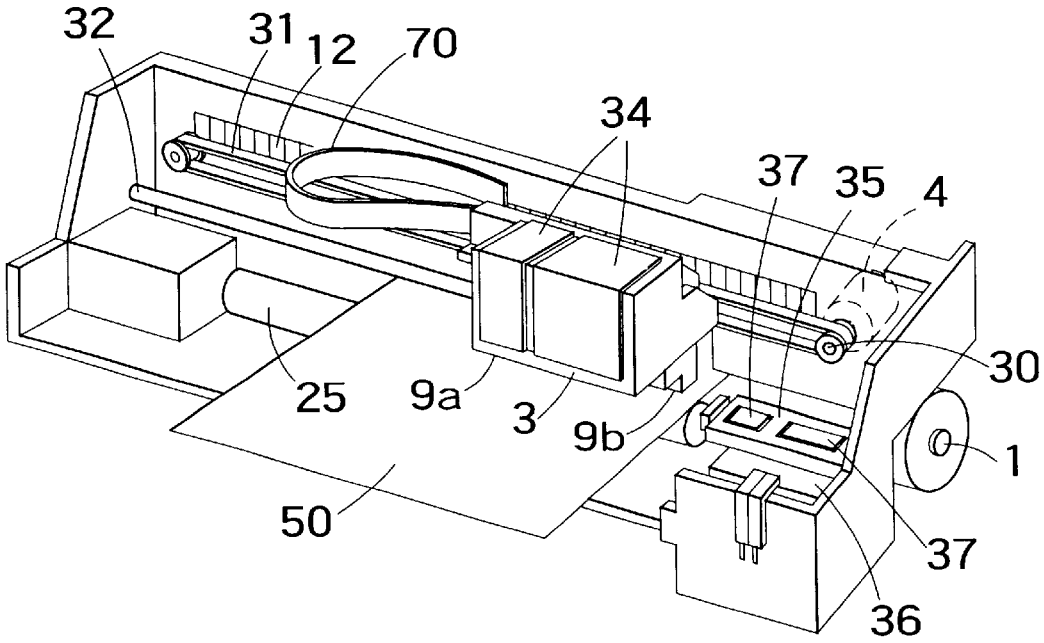
FIG. 7 is a perspective illustration of a carriage 3 and its peripherals in an inkjet printer.

FIG. 7 is a perspective illustration of the carriage 3 and its peripherals of the inkjet printer.

As illustrated in FIG. 7, the carriage 3 is driven as being moved along a guide 32 in the direction parallel to the platen 25 with the timing belt 31 running on the pulley 30 coupled to the carriage motor 4. Provided on the printing-paper facing surface of the carriage 3 is a print head 9 having nozzle alignment for spraying black ink and another nozzle alignment for spraying color ink. Each nozzle splays ink supplied by the ink cartridge 34 onto the printing paper to print characters and/or images thereon.

Incorporated into the inkjet printer within a non-printing area for the carriage 3 are capping unit 35 for capping the nozzles of the print head 9 while no printing process is performed and a pump unit 36 having the pump motor 7 shown in FIG. 6. The carriage 3 touches a lever (not shown) when it has moved from a printing area to the non-printing area. This action leads the capping unit 35 to move up to cap the head 9.

The pump unit 36 sucks ink from the nozzles of the head 9 by means of negative pressure in case of ink plugging occurred to the nozzles or forcefully spraying ink from the head 9 in the replacement of cartridge 34. This ink suction cleans up the nozzles from paper dust and any other dust attached the head 9 close to the nozzle openings and also discharges bubbles generated in the head with ink.

Figure 8:
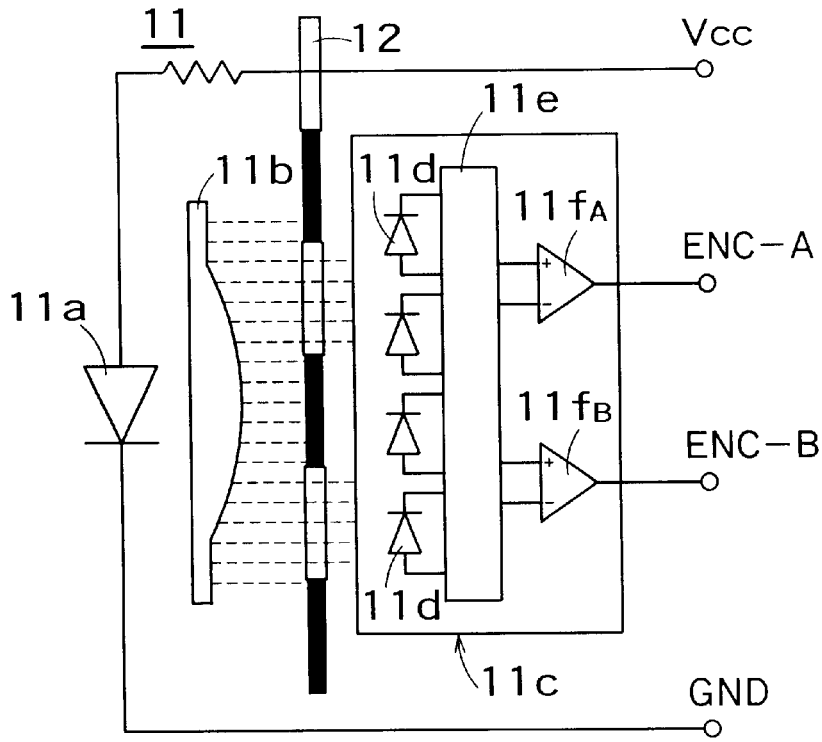
FIG. 8 is a schematic illustration of a linear encoder 11 attached to the carriage 3.

FIG. 8 is a schematic illustration of a linear encoder 11 attached to the carriage 3.

The encoder 11 shown in FIG. 8 is equipped with a light-emitting diode 11*a*, a collimator lens 11*b* and a detection processor 11*c*. The detection processor 11*c* has several (four) photodiodes lid, a signal-processing circuit 11*e* and two comparators $\mathbf{11}f_A$ and $\mathbf{11}f_B$.

The light-emitting diode 11*a* emits light when a voltage Vcc is supplied across the diode 11*a* via resistor. The light is converged into parallel beams by the collimator lens 11*b*, which then pass through the code disk 12. Formed on the code disk 12 are several slits with a specific interval, such as 1/180 inches (1 inch=2.54 cm).

The parallel beams passing through the code disk 12 are incident to the photodiodes lid passing through fixed slits (not shown) and converted into electrical signals. The electrical signals output from the four photodiodes lid are processed by the signal-processing circuit 11*e*. The output signals of the circuit 11*e* are compared with a predetermined value by the comparators $\mathbf{11}f_A$ and $\mathbf{11}f_B$, respectively, thus outputting pulses as comparison results. Output pulses ENC-A and ENC-B of the comparators $\mathbf{11}f_A$ and $\mathbf{11}f_B$ are the outputs of the encoder 11.

Figure 9A:
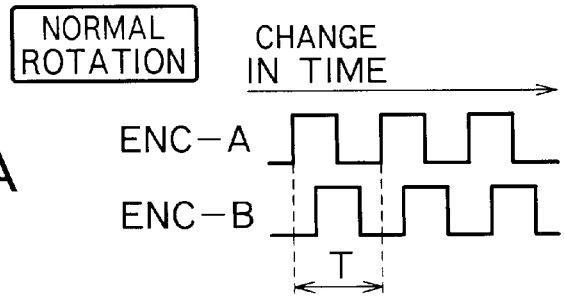
FIGS. 9A and 9B are timing charts indicating two signal waveforms output from the encoder 11 in CR-motor normal rotation and reverse rotation, respectively.
Figure 9B:
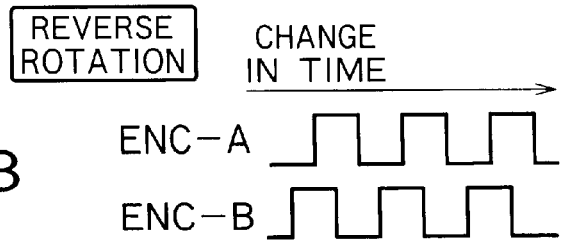

FIGS. 9A and 9B are timing charts indicating two signal waveforms output from the encoder 11 in CR-motor normal rotation and reverse rotation, respectively.

As illustrated in FIGS. 9A and 9B, the pulses ENC-A and ENC-B are shifted from each other by 90 degrees in phase in both CR-motor normal rotation and reverse rotation. In detail, the encoder 4 operates such that, as shown in FIG. 9A, the pulse ENC-A advances from the pulse ENC-B by 90 degrees in phase during the normal rotation of the CR-motor 4 whereas, as shown in FIG. 9B, the pulse ENC-A is delayed from the pulse ENC-B by 90 degrees in phase during the reverse rotation of the CR-motor 4. Each cycle T of the pulses corresponds to the slit interval (1/180 inches, etc) on the code disk 12 and is equal to the time in which the carriage 3 traverses each slit interval.

The rotary encoder 13 used for the PF motor 1 has almost the same structure as the linear encoder 11 except that a code disk of the encoder 13 is a rotary disk rotating with the PF motor 1, to output two pulses ENC-A and ENC-B. Several slits formed on the code disk of the rotary encoder 13 have a slit interval of 1/180 inches. A printing paper is fed by 1/1440 inches while the PF motor 1 rotates by an angle corresponding to each slit interval.

Figure 10:
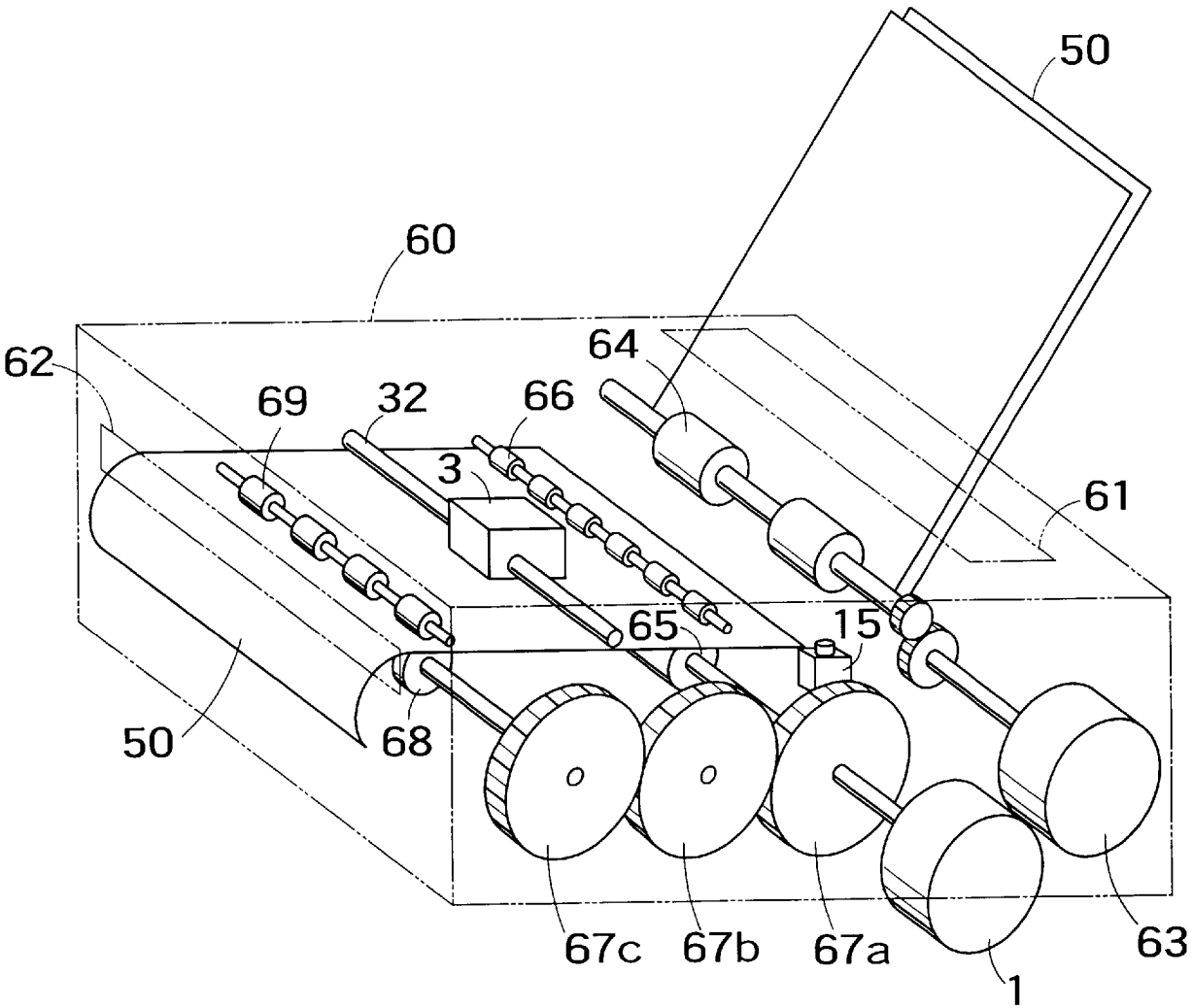
FIG. 10 is a perspective illustration of paper-supplying and detecting mechanisms.

FIG. 10 is a perspective illustration of paper-supplying and detecting mechanisms.

The location of the paper sensor 15 shown in FIG. 6 is explained with reference to FIG. 10. Each printing paper 50 inserted into a paper-supply opening 61 is fed into a printer 60 by a paper-supply roller 64 driven by a paper-supply motor 64. The front edge of the printing paper 50 fed into the printer 60 is detected by the paper sensor 15 such as an optical sensor. The paper feed advances with a paper-feed roller 65 driven by the PF motor 1 and a driven roller 66 for the printing paper 50 for which the front edge has been detected by the paper sensor 15.

A printing process is carried out with ink splayed on the printing paper 50 from the print head (not shown) attached to the carriage 3 moving along the carriage guide 32. When the printing paper 50 has been fed to a specific position, its rear edge is detected by the paper sensor 15 during printing. On completion of printing, the printing paper 50 is discharged to the outside through a paper-discharging opening 62 by a paper-discharging roller 68 driven by a gear 67*c* meshed with gears 67*a* and 67*b* driven by the PF motor 1 and also a driven roller 69. The rotary shaft of the paper-feed roller 65 is coupled to the rotary encoder 13.

Figure 11:
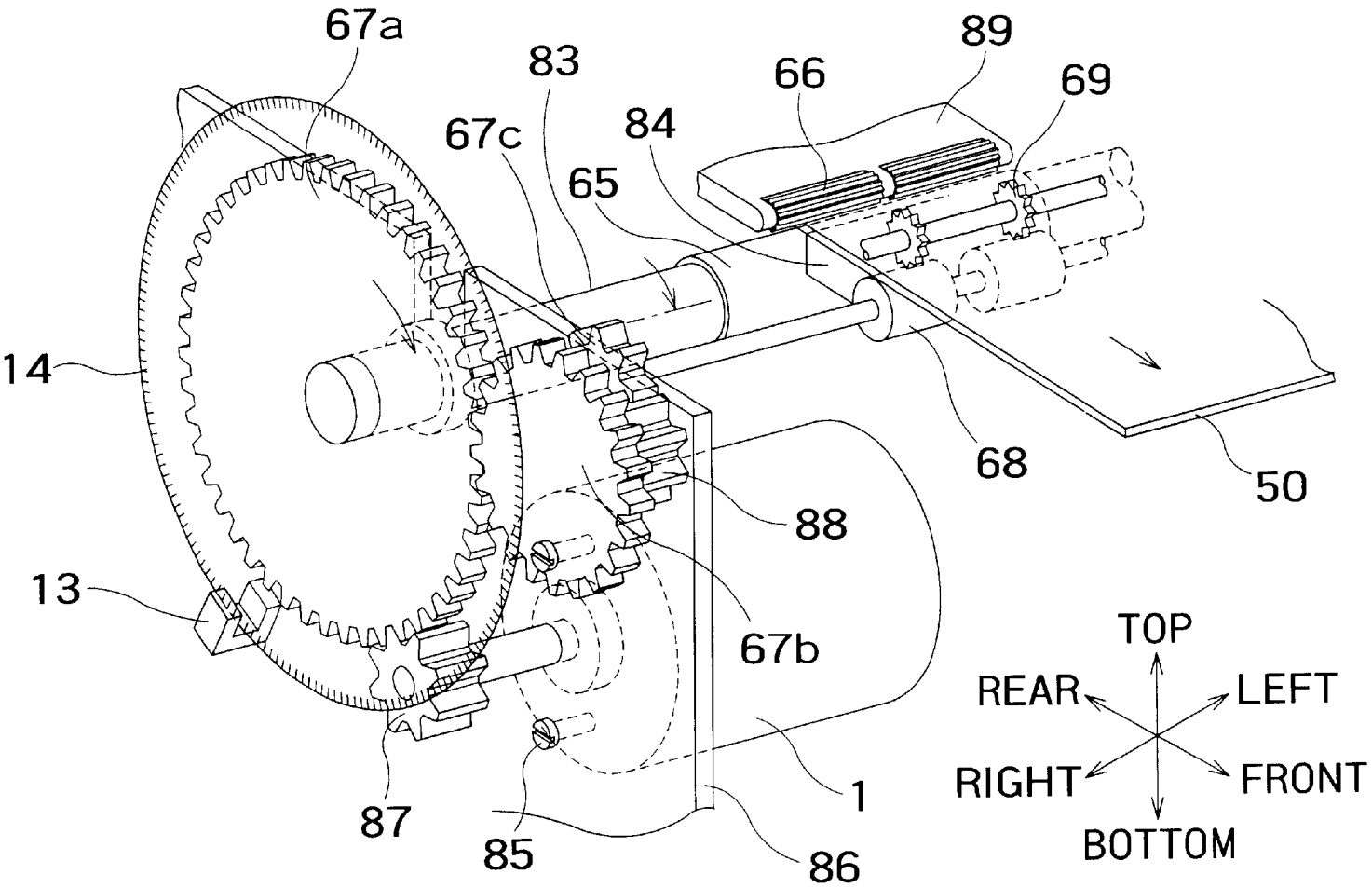
FIG. 11 is a detailed perspective illustration of the paper-feeding mechanism.

FIG. 11 is a detailed perspective illustration of the paper-feeding mechanism.

The paper-feeding mechanism of the printer shown in FIG. 10 is disclosed further in detail with reference to FIGS. 10 and 11.

The paper feed advances with the paper-feed roller 65 and the driven roller 66 on detection of the front edge of the printing paper 50 by the paper sensor 15, which has been inserted into the paper-supply opening 61 and fed into the printer 60 by the paper-supply roller 64. The paper-feed roller 65 is attached on a smap shaft 83, the rotary shaft of a large gear 67*a* driven by the PF motor 1 via a small gear 87. The driven roller 66 is attached to a holder 89 at its tip of the paper-discharging side in a paper-feeding direction. The holder 89 presses the printing paper 50 sent from paper-supplying side in the vertical direction.

The PF motor 1 is mounted on a frame 86 with a screw 85 in the printer 60. The rotary encoder 13 is attached to the large gear 67*a* at its specific position. Coupled to the smap shaft 83, the rotary shaft of the large gear 67*a* is a code disk 14 of the rotary encoder.

The printing paper 50 fed by the paper-feed roller 65 and the driven roller 66 passes on a platen 84 that supports the paper 50 and is fed further by the paper-discharging roller 68 driven by the PF motor 1 via the small gear 87, the large gear 67*a*, an intermediate gear 67*b*, a small gear 88 and the paper-discharging gear 67*c*, and also a driven roller 69 having saw-toothed wheels, and then discharged outside through the paper-discharging opening 62.

While the printing paper 50 is supported on the platen 84, the carriage 3 moves left and right along the guide 32 in a space over the platen 84, ink being sprayed from the print head (not shown) for a printing process.

Explained next is the architecture of DC unit 6, a known DC-motor controller for controlling the CR motor 4 of the inkjet printer described above, and also a printer-control method using the DC unit 6.

Figure 12:
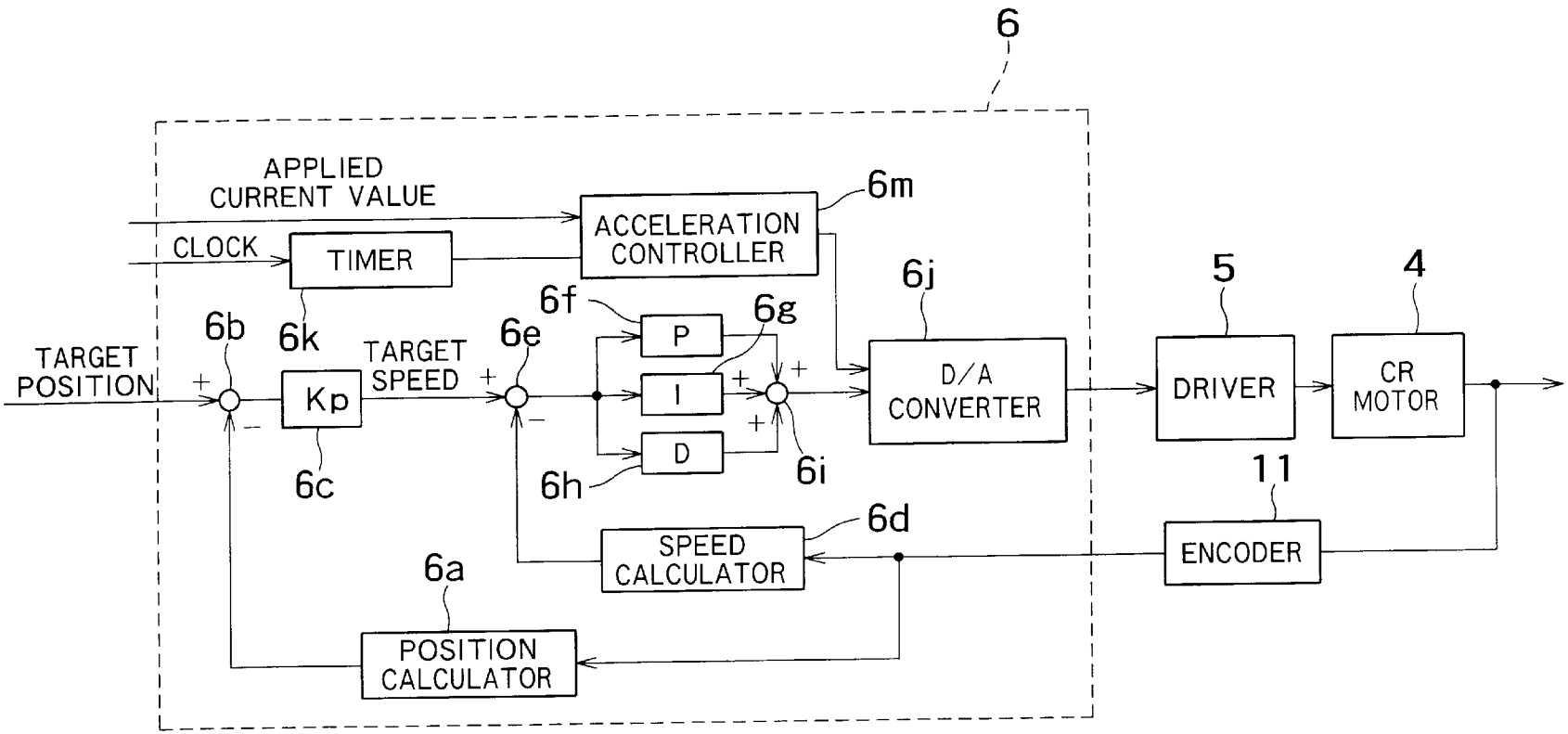
FIG. 12 is a block diagram of a DC unit 6 as a DC-motor controller.
Figures 13A, 13B:
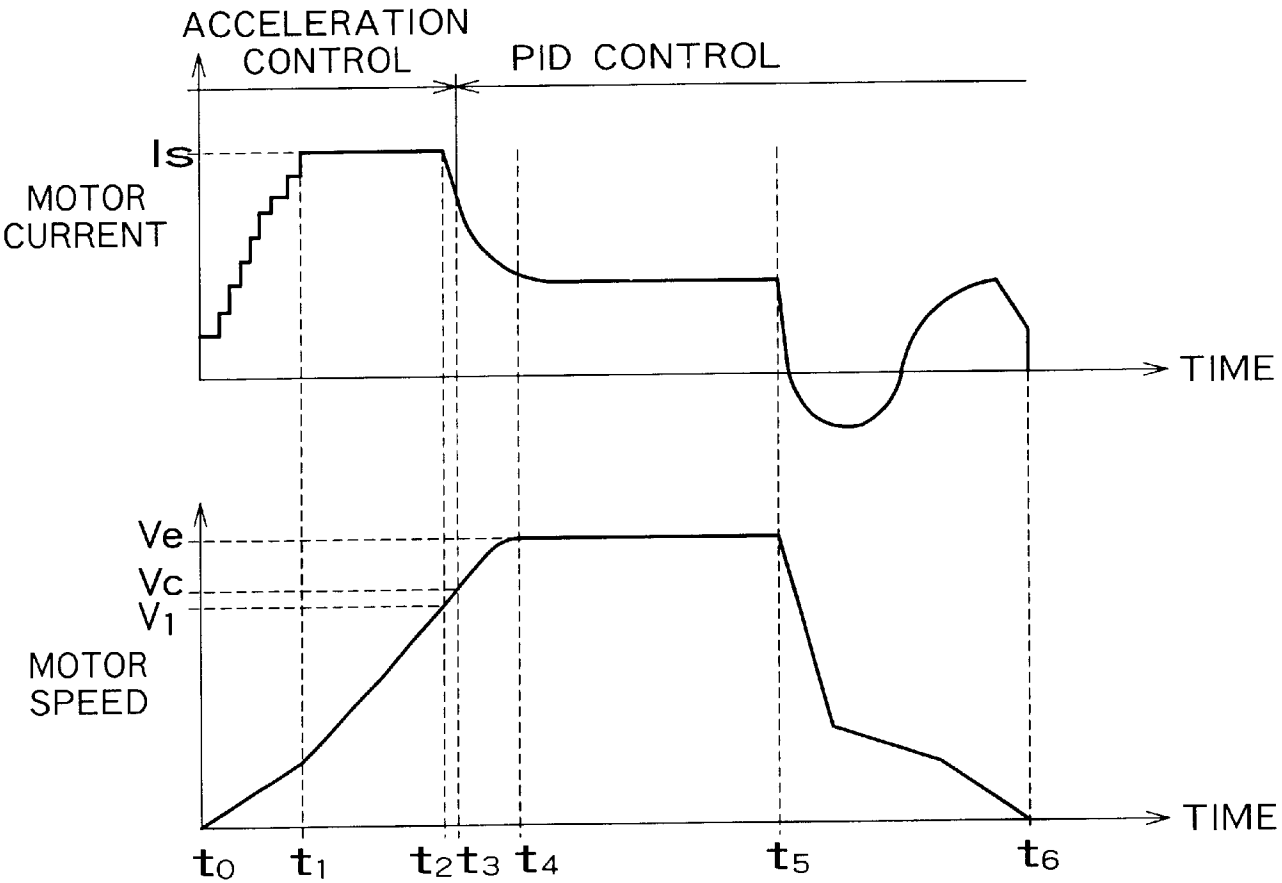
FIGS. 13A and 13B are graphs indicating motor currents and motor speeds for a CR motor 4 controlled by the DC unit 6.

FIG. 12 is a block diagram of the DC unit 6 as a known DC-motor controller. FIGS. 13A and 13B are graphs indicating motor currents and motor speeds for the CR motor 4 controll by the DC unit 6.

The DC unit 6 shown in FIG. 12 is equipped with a position calculator 6*a*, a subtracter 6*b*, a target-speed calculator 6*c*, a speed calculator 6*d*, a subtracter 6*e*, a proportional component 6*f*, an integral component 6*g*, a differential component 6*h*, an adder 6*i*, a D/A converter 6*j*, a timer 6*k* and an acceleration controller 6*m*.

The position calculator 6*a* detects rising and falling edges of each of the output pulses ENA-A and ENA-B of the encoder 11 and counts the number of detected edges to compute the position of the carriage 3 based on the count value. The counting is performed with addition of [+1] on detection of one edge during the normal rotation of the CR motor 4 whereas addition of [−1] on detection of one edge during the reverse rotation of the CR motor 4. The count value [1] corresponds to ¼ of the slit interval on the code disk 12 because the cycle of both pulses ENA-A and ENA-B is equivalent to the slit interval on the code disk 12 and the pulses ENA-A and ENA-B are shifted from each other by 90 degrees in phase. Thus, multiplication of the count value by ¼ of the slit interval gives the amount of movement for the carriage 3 from the position corresponding to a count value [0]. The resolution for the encoder 11 at the given amount of movement corresponds to ¼ of the slit interval on the code disk 12. The resolution is 1/720 inches to a 1/180-inch slit interval.

The subtracter 6*b* calculates a positional deviation of the actual position of the carriage 3 obtained by the position calculator 6*a* from a target position sent from the CPU 16.

The target-speed calculator 6*c* calculates a target speed for the carriage 3 based on the positional deviation, the output of the subtracter 6*b*. This calculation is performed by multiplying the positional deviation by a gain Kp. The gain Kp is decided in accordance with the positional deviation. Several values for the gain Kp may be stored in a table (not shown).

The speed calculator 6*d* calculates a speed of the carriage 3 based on the output pulses ENA-A and ENA-B of the encoder 11. This speed is obtained as follows: The rising and falling edges of the output pulses ENA-A and ENA-B of the encoder 11 are detected and a time interval between the detected edges corresponding to ¼ of the slit interval on the code disk 12 is counted by the timer counter. The carriage speed is then given by ./4T where . is the slit interval on the code disk 12 and T is the count value. The speed calculation is performed with measurements, by the timer counter, of one cycle of the output pulse ENA-A, for example, from its specific rising edge to the next rising edge.

The subtracter 6*e* calculates a speed deviation of the actual speed of the carriage 3 calculated by the speed calculator 6*d* from a target speed.

The proportional component 6*f* multiplies the speed deviation by a constant Gp and outputs the result of multiplication. The integral component 6*g* integrates speed deviations each multiplied by a constant Gi. The differential component 6*h* multiplies a difference between the current speed deviation and another speed deviation obtained just before the current speed deviation by a constant Gd and outputs the result of multiplication. The computations at the proportional component 6*f*, the integral component 6*g* and the differential component 6*h* are performed for each cycle of the output pulse ENA-A, for example, in synchronism with each rising edge of the output pulse ENA-A.

The outputs of the proportional component 6*f*, the integral component 6*g* and the differential component 6*h* are added by the adder 6*i*. The result of addition, or a drive current for the CR motor 4 is sent to the D/A converter 6*j* and converted into an analog current. The CR motor 4 is then driven by the driver 5 based on the analog current.

The timer 6*k* and the acceleration controller 6*m* are used for acceleration control. The PID control with the proportional component 6*f*, the integral component 6*g* and the differential component 6*h* is performed for constant-speed control during acceleration and deceleration control.

The timer 6*k* generates a timer-interrupting signal per specific period based on a clock signal sent from the CPU 16.

The acceleration controller 6*m* performs integration by adding a specific current value (for example, 20 mA) to a target current value for each receipt of the timer-interrupting signal. The result of integration, or a target current value for the DC motor 4 during acceleration is sent to the D/A converter 6*j*. Like the PID control, the target current value is converted into an analog current by the D/A converter 6*j*. The CR motor 4 is then driven by the driver 5 based on the analog current.

The driver 5 has, for example, four transistors. Each transistor is turned on or off based on the output of the D/A converter 6*j* for several modes: (a) a driving mode for driving the CR motor 4 in normal or reverse rotation, (b) a regenerative braking mode (short braking mode, a mode for keeping the CR motor at a halt), and (c) a mode for bringing the CR motor to a halt.

Described next with reference to FIGS. 13A and 13B is an operation of the DC unit 6, or a known motor-control method.

The acceleration controller 6*m* supplies a start-up initial current value I0 to the D/A converter 6*j* when a start-up command signal for starting the CR motor 4 is sent from the CPU 16 to the DC unit 6 during the CR motor 4 is keeping at a halt. The start-up initial current value I0 has been sent to the acceleration controller 6*m* from the CPU 16 with the start-up command signal. The start-up initial current value I0 is converted into an analog current by the D/A converter 6*j*. The analog current is then sent to the driver 5 to start the CR motor 4 (as shown in FIGS. 13A and 13B). After receipt of the start-up command signal, the timer 6*k* generates a timer-interrupting signal per specific period. At each receipt of the timer-interrupting signal, the acceleration controller 6*m* performs integration by adding a specific current value (for example, 20 mA) to the start-up initial current value I0. The integrated current value is sent to the D/A converter 6*j*. The integrated current value is then converted into an analog current by the D/A converter 6*j*. The analog current is sent to the driver 5. The driver 5 drives the CR motor 4 to increase the motor speed with the current value supplied to the CR motor 4 equal to the integrated current value (as shown in FIG. 13B). The current value being supplied to the CR motor 4 varies stepwise as shown in FIG. 13A. The D/A converter 6*j* selects and receives the output of the acceleration controller 6*m* while the PID control is also being carried out.

The current-value integration procedure at the acceleration controller 6*m* continues until the integrated current value reaches a constant current value Is. The acceleration controller 6*m* halts the integration procedure when the integrated current value has reached the constant current value Is at the moment t1 and supplies the constant current value Is to the D/A converter 6*j*. The driver 5 thus drives the CR motor 4 with the constant motor-current value Is (as shown in FIG. 13A).

For prevention of the motor speed of the CR motor from overshoot, the acceleration controller 6*m* decreases the current supplied to the CR motor 4 when the motor speed has reached a specific speed V1 (at a moment t2). The speed of the CR motor 4 becomes higher and when it has reached a specific speed Vc (at a moment t3 in FIG. 13B), the D/A converter 6*j* selects the output for PID control, or the output of the adder 6*i* for PID control.

A target speed is calculated based on a positional deviation of the actual position obtained from the output of the encoder 11 from a target position. The proportional component 6*f*, the integral component 6*g* and the differential component 6*h* perform proportional, integral and differential computations, respectively, based on a speed deviation of the actual speed obtained from the output of the encoder 11 from the target speed. The CR motor 4 is then controlled based on the addition of the results of these computations. The proportional, integral and differential computations are performed in synchronism with each rising edge of the output pulse ENC-A of the encoder 11, for example. The DC motor 4 is controlled based on these computations so that the motor speed can be kept at a specific speed Ve. The specific speed Vc is preferably 70 to 80% of the specific speed Ve.

The DC motor 4 is kept at a desired speed from a moment t4 so that the carriage 3 can move at the desired constant speed Ve for a printing process.

When the printing process is completed and the carriage 3 has moved near a target position (at a moment t5 as shown in FIG. 13), the positional deviation and hence the target speed has become small. The speed deviation, or the output of the subtracter 6*e* thus becomes negative, so that the DC motor 4 decelerates to stop at a moment t6.

Drive control in the case where a DC motor is a CR motor 4 has been described above. Drive control in the case where the DC motor is a paper-feed motor (PF motor) 1 or a paper-supply motor is generally the same as in the above-described case.

An embodiment of printer-control method and printer-control apparatus according to the present invention will be described hereinafter with reference to the drawings.

Figure 14:
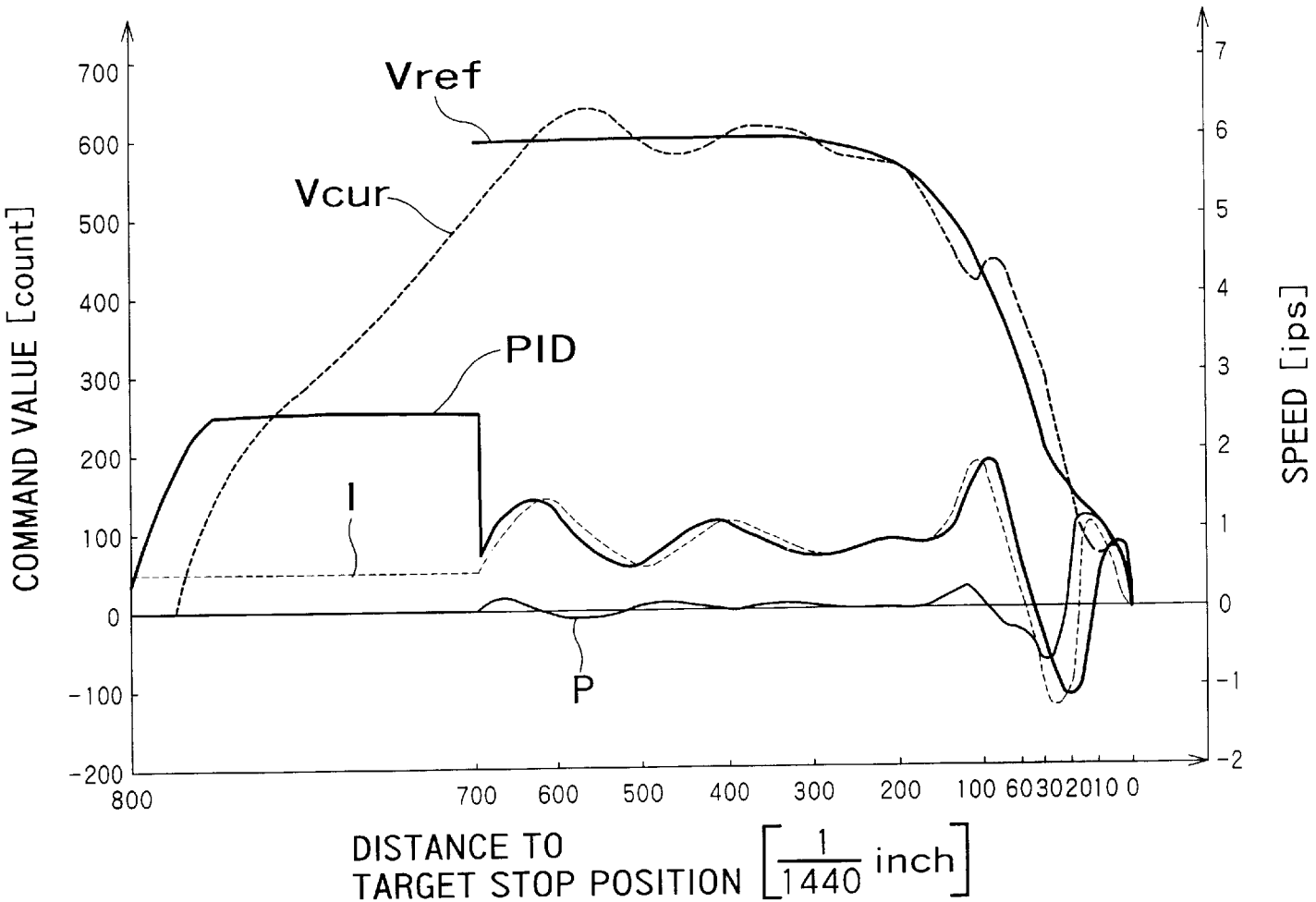
FIG. 14 is a graph showing a target speed of the paper-supply motor which is controlled by a printer-control method and a printer-control apparatus according to the present invention, an actual motor speed and waveforms of control signals.
Figure 15:
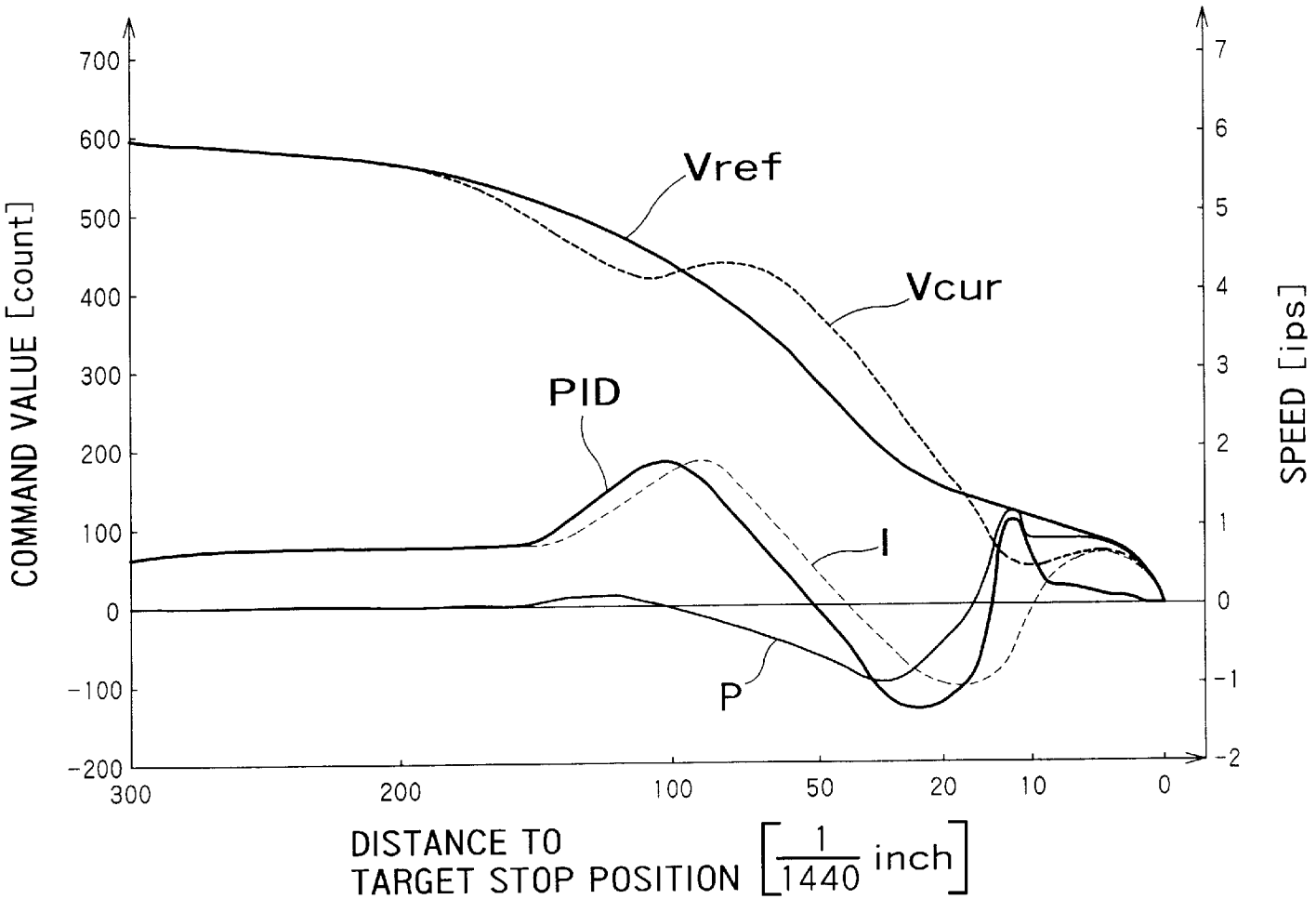
FIG. 15 is a graph of section from 300 to 0 of remaining distance to a target stop position shown in FIG. 14 with only horizontal axis being enlarged.

FIG. 14 is a graph showing a target speed of the paper-supply motor that is controlled by a printer-control method and a printer-control apparatus according to the present invention, an actual motor speed and waveforms of control signals. FIG. 15 is a graph of section from 300 to 0 of remaining distance to a target stop position shown in FIG. 14 with only a horizontal axis being enlarged.

In accordance with the printer-control method and the printer-control apparatus according to the present invention, it is characterized in that in speed control for the paper-supply motor from the time when a paper-supply roller starts a paper-supply operation to the time when the paper-supply roller is stopped in order to deskew a printing paper, i.e., to the time when an upper end of printing paper abuts against a paper-feed roller and a driven roller thereof and then the paper-supply roller is stopped with the upper end portion of the printing paper being nipped by the paper-feed roller and the driven roller thereof, if a difference between a target speed and a current speed in a constant speed section under PID control serving as a feedback control becomes equal to or larger than a predetermined value, a proportional gain coefficient used for speed control calculation is changed to a value which is larger than an usual value.

In accordance with conventional printer-control method and printer-control apparatus, in speed control for the paper-supply motor from the time when a paper-supply roller starts a paper-supply operation to the time when the paper-supply roller is stopped in order to deskew a printing paper, in order to converge as soon as possible undershoot and overshoot of current speed with respect to a target speed that are caused by abutment of upper end of printing paper against a paper-feed roller and a driven roller, when a difference between the target speed and the current speed in a speed reduction section under PID control immediately before the paper-supply roller stops becomes equal to or larger than a predetermined value, a proportional gain coefficient used for speed control calculation is changed to a value larger than an usual value. This is because undershoot and overshoot of the current speed with respect to the target speed that are caused by abutment of the upper end of the printing paper against the paper-feed roller and the driven roller often occur at the speed reduction section under PID control.

On the other hand, in a constant speed section under PID control, a proportional gain coefficient used for speed control calculation is always fixed to be relatively small usual value. This is because undershoot and overshoot of current speed with respect to target speed that are caused by an upper end of printing paper abutting against a paper-feed roller and a driven roller do not occur often. Further, if the proportional coefficient used for speed control calculation is always set to be a larger value, vibration and unpleasant noise due to resonance in a driving force transmitting mechanism are generated. Because of that, the proportional coefficient used for speed control calculation is always set to be relatively small usual value.

Nevertheless, if a nipping amount C of printing paper at a target stop position at which the paper-supply roller is stopped in order to deskew the printing paper is large, undershoot and overshoot of the current speed with respect to the target speed that are caused by abutment of the upper end of the printing paper against the paper-feed roller and the driven roller may be generated at a constant speed section under PID control. In accordance with conventional printer-control method and printer-control apparatus, however, a proportional gain coefficient used for speed control calculation in the constant speed section is always fixed to be relatively small usual value. Thus, undershoot and overshoot generated in the aforementioned case cannot be appropriately converged. Further, depending on a size or a duration of undershoot and overshoot, a current speed becomes 0 before the paper-supply roller reaches the target stop position and thus the paper-supply motor and the printing paper may be stopped on their way.

In accordance with printer-control method and printer-control apparatus according to the present invention, in speed control for the paper-supply motor from the time when a paper-supply roller starts a paper-supply operation to the time when the paper-supply roller is stopped in order to deskew a printing paper, i.e., to the time when an upper end of the printing paper abuts against a paper-feed roller and a driven roller thereof and then the paper-feed roller is stopped with the upper end portion of the printing paper being nipped by the paper-feed roller and the driven roller thereof, when a difference between a target speed and a current speed in a constant speed section under PID control becomes equal to or larger than a predetermined value, a proportional gain coefficient used for speed control calculation is changed to a value which is larger than an usual value.

Speed control for the paper-supply motor by the printer-control method and the printer-control apparatus according to the present invention will be described in detail with reference to a graph of FIG. 14.

A target stop position in FIG. 14 shows a position at which an upper end of printing paper is nipped by a paper-feed roller 65 and a driven roller 66 by a predetermined nipping amount C and a paper-supply roller 64 is stopped in order to deskew the printing paper.

At a section from 800 (1/1440 inches (1 inch=2.54 cm) a unit will be appropriately omitted hereinafter) to 700 of remaining distance to a target stop position, a PID waveform is shown. Nevertheless, this section is not a PID control section but an acceleration control section. At this section, acceleration toward a target speed Vref in a constant speed section from 700 to 300 of remaining distance is performed.

At the constant speed section from 700 to 200 of remaining distance, PID control starts. The PID control is performed until the paper-supply motor is stopped in order to stop the paper-supply roller 64 at the target stop position. At the constant speed section, the PID control is performed in order to converge undershoot and overshoot of current speed Vcur with respect to the target speed Vref.

In accordance with the printer-control method and the printer-control apparatus according to the present invention, from the time when the constant speed section starts, when a difference between the target speed Vref and the current speed Vcur becomes equal to or larger than a predetermined value, a proportional gain coefficient used for speed control calculation is changed to a value that is larger than an usual value. Accordingly, even if undershoot and overshoot of the current speed Vcur with respect to the target speed Vref occur at the constant speed section, such undershoot and overshoot can be converged more rapidly than conventional cases.

A speed reduction section starts from 200 of remaining distance. In an example of the graph shown in FIG. 14, undershoot and overshoot of the current speed Vcur with respect to the target speed Vref occur immediately after the speed reduction section starts. At this time, when a difference between the target speed Vref and the current speed Vcur becomes equal to or larger than a predetermined value, a proportional gain coefficient used for speed control calculation is changed to a value which is larger than an usual value. Thus, a larger value than usual is outputted as a PID command value for instructing temporal acceleration and deacceleration in accordance with generation of undershoot and overshoot of the current speed Vcur with respect to the target speed Vref. Thereby, undershoot and overshoot of the current speed Vcur with respect to the target speed Vref that are caused by an upper end of printing paper abutting against the paper-feed roller and the driven roller thereof can be rapidly and appropriately converged. As a result, it is possible to prevent the printing paper from being stopped on its way caused by such undershoot and overshoot.

When a difference between the target speed Vref and the current speed Vcur becomes equal to or larger than a predetermined value when the constant speed section starts, a proportional gain coefficient used for speed control calculation is set to be changed to a larger value than usual. Thus, even if undershoot and overshoot of the current speed Vcur with respect to the target speed Vref are generated at the constant speed section, the same effects can be obtained.

As a result, as shown in FIG. 14, it is possible to perfectly prevent a printing paper from stopping on its way before reaching a target stop position.

A size of undershoot of the current speed Vcur generated by abutment of printing paper is varied depending on a type of the printing paper or an angle formed of an upper end of the printing paper, a paper-feed roller and a driven roller. Generally, the thicker the printing paper is, the larger the undershoot of the current speed Vcur is. Further, as an upper end of the printing paper is parallel to the paper-feed roller and the driven roller, the undershoot of the current speed Vcur becomes large. The wider the printing paper is, the larger the undershoot of the current speed Vcur is. If a printing paper which is thicker than a set thickness is used or two or more printing papers are fed in error, the undershoot of the current speed Vcur becomes large.

Thus, when a proportional gain coefficient used for speed control calculation is set to be changed to a larger value than usual value, it is desirable that the proportional gain coefficient is changed to a larger value that can handle the largest undershoot that may be generated, by taking various conditions into consideration about how much larger the proportional gain coefficient is changed.

The condition on which the proportional gain coefficient used for speed control calculation is changed is when a difference between a target speed Vref and a current speed Vcur becomes equal to or larger than a predetermined value. The predetermined value is desirably set on the basis of experiments and simulations so that the proportional gain coefficient is set to be changed at a timing that undershoot and overshoot of the current speed Vcur with respect to the target speed Vref are rapidly and appropriately converged. For example, the proportional gain coefficient is desirably set to be changed when a difference between the target speed Vref and the current speed Vcur becomes equal to or larger than ±10% of the target speed Vref.

As described above, undershoot and overshoot of the current speed Vcur with respect to the target speed Vref that are caused by abutment of upper end of printing paper against the paper-feed roller and the driven roller are generated in a constant speed section when a nipping amount C of the printing paper is set to be a larger value.

The case in which the nipping amount C of the printing paper at a target stop position at which the paper-supply roller 64 is stopped in order to deskew the printing paper is set to be large refers to as the case where the printing paper is set to abut before deacceleration starts. In such cases, maximum effects of applying the printer-control method and a structure of the printer-control apparatus according to the present invention can be obtained.

Then, on the condition that the nipping amount C of printing paper with respect to the paper-feed roller and the driven roller thereof is set to be equal to or larger than a predetermined value at a target stop position at which the paper-supply motor is stopped in order to deskew the printing paper, i.e., the target stop position at which the upper end of the printing paper abuts against the paper-feed roller and the driven roller thereof and then the paper-supply motor is stopped with the upper end portion of the printing paper being nipped by the paper-feed roller and the driven roller thereof when a difference between the target speed and the current speed in a constant speed section under PID control becomes equal to or larger than a predetermined value, control for changing a proportional gain coefficient used for speed control calculation to a value which is larger than an usual value may be performed. A predetermined nipping amount C is a minimum value of the nipping amount when a printing paper abuts against the paper-feed roller and the driven roller thereof in the constant speed section under PID control.

As described above, the printer-control apparatus according to the present invention comprises PID control components 6*f*, 6*g* and 6*h* for changing a proportional gain coefficient used for speed control calculation to a value which is larger than an usual value when a difference between a target speed and a current speed in a constant speed section under PID control becomes equal to or larger than a predetermined value in speed control for the paper-supply motor from the time when a paper-supply roller starts a paper-supply operation to the time when the paper-supply roller is stopped in order to deskew a printing paper, i.e., to the time when an upper end of the printing paper abuts the paper-feed roller and the driven roller thereof and then the paper-supply roller is stopped with the upper end portion of the printing paper being nipped by the paper-feed roller and the driven roller thereof. Further, as described above, the PID control components 6*f*, 6*g* and 6*h* may perform control of changing a proportional gain coefficient on the condition that a nipping amount C of printing paper with respect to the paper-feed roller and the driven roller thereof at the target stop position at which the paper-supply motor is stopped in order to deskew a printing paper, i.e., at the target stop position at which an upper end of the printing paper abuts against the paper-feed roller and the driven roller thereof and then the paper-supply motor is stopped with the upper end of the printing paper being nipped by the paper-feed roller and the driven roller thereof becomes equal to or larger than a predetermined value. An overall structure of the printer-control apparatus according to the present invention is the same as that of motor-control apparatus shown in FIG. 12.

In addition to PID control, P control or PI control may be employed as feedback control.

The printer-control apparatus according to the present invention may be formed of a CPU 16 shown in FIG. 6. In this case, a program for operating the CPU 16 may be recorded, for example, a PROM 21 or an EEPROM 23 in addition to a storage medium to be described below.

Figure 16:
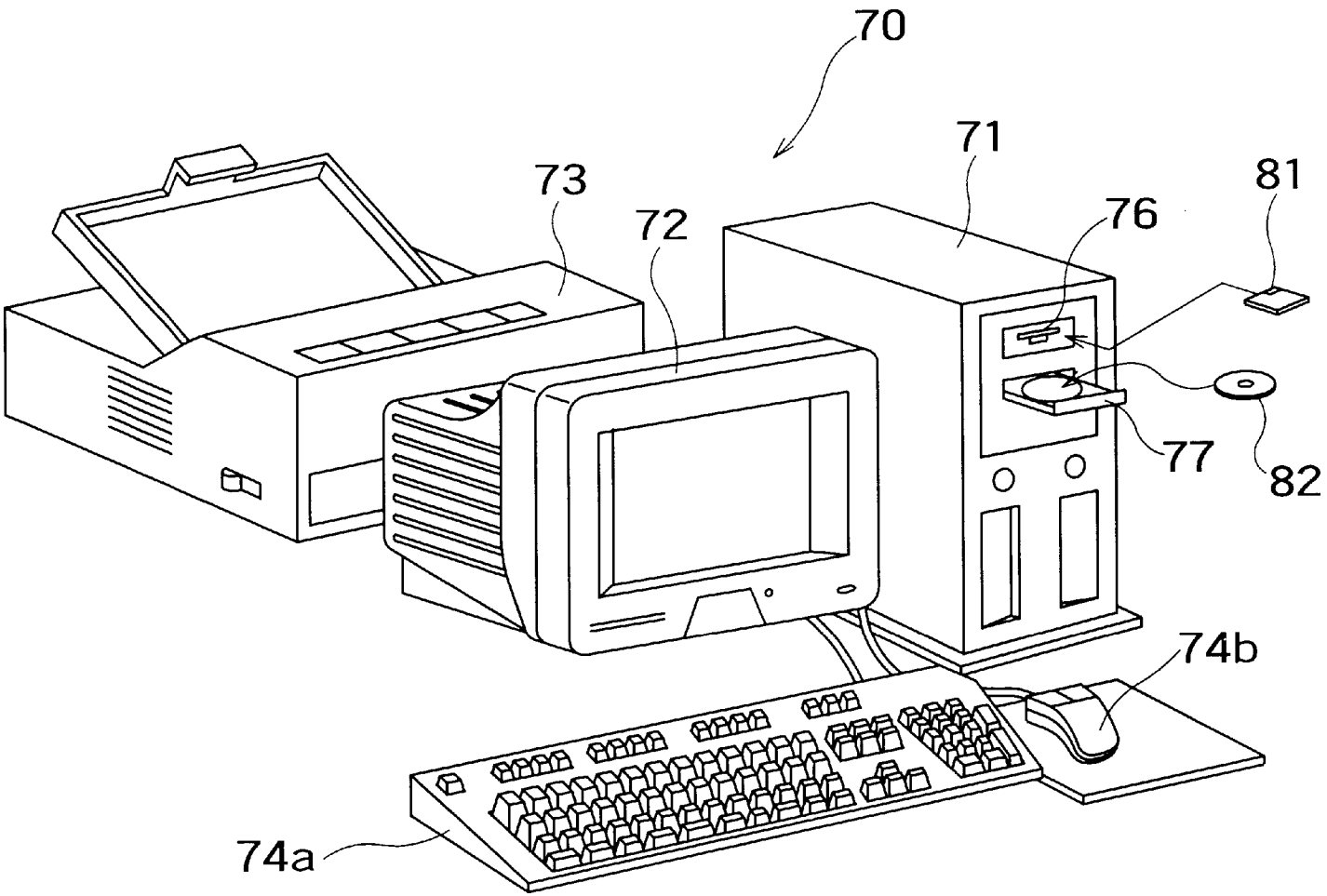
FIG. 16 is an illustration of storage media each storing a program for executing any of the printer-control methods of the present invention, and a computer system that runs the program stored on each storage medium.
Figure 17:
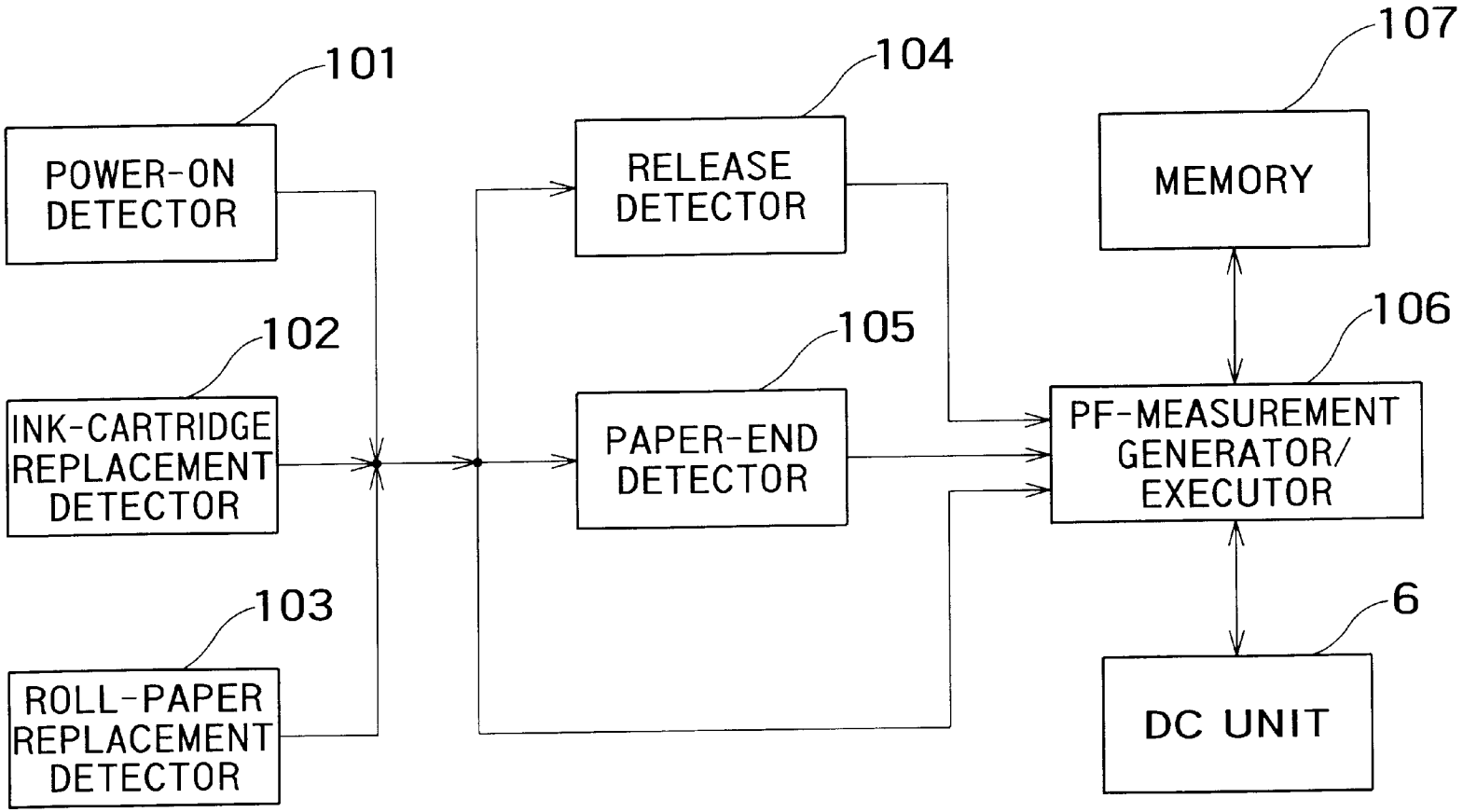
FIG. 17 is a block diagram of the computer system illustrated in FIG. 16.

FIG. 16 is an illustration of storage media each storing a program for executing a printer-control method of the present invention, and a computer system that runs the program stored on each storage medium. FIG. 17 is a block diagram of the computer system illustrated in FIG. 16.

A computer system 70 shown in FIG. 16 is equipped with the following components: a computer 71 installed in a mini-tower frame; a display unit 72, such as a CRT (cathode Ray Tube), a Plasma display and liquid-crystal display; a printer 73 as a recording/output unit; a key board 74*a* and a mouse 74*b* as an input unit; a flexible-disk drive 76; and a CD-ROM drive 77. Shown in FIG. 17 is a block diagram of the computer system 70. Further incorporated into the frame in which the computer 71 is installed are an internal memory 75 such as a RAM (Random Access Memory) and an external memory such as hard-disk drive unit 78. A storage medium storing a program for executing a printer-control method of the present invention is used for the computer system 70. Representatives of the storage medium are a flexible disk 81 and a CD-ROM (Read Only Memory) 82. Other types of storage media, such as MO (Magneto Optical) disk, DVD (Digital Versatile Disk), other types of optical disk, card memory and magnetic tape can also be used as the storage medium storing a program for executing a printer-control method of the present invention.

What is claimed is:

1. A printer-control method in speed control for a paper-supply motor from the time when a paper-supply roller starts a paper-supply operation to the time when an upper end of a printing paper abuts against a paper-feed roller and a driven roller thereof and then the paper-supply motor is stopped with the upper end portion of the printing paper being nipped by the paper-feed roller and the driven roller thereof, when a difference between a target speed and a current speed in a constant speed section under feedback control becomes equal to or larger than a predetermined value, a proportional gain coefficient used for speed control calculation is changed to a value which is larger than an usual value.

2. The printer-control method according to claim 1, wherein control for changing said proportional gain coefficient can be performed on the condition that a nipping amount of the printing paper with respect to the paper-feed roller and the driven roller thereof at a target stop position at which said paper-supply motor is stopped with the upper end portion of the printing paper being nipped by the paper-feed roller and the driven roller thereof is set to be equal to or larger than a predetermined value.

3. The printer-control method according to claim 2, wherein said predetermined value of said nipping amount is a minimum value of said nipping amount in the case where the printing paper abuts against the paper-feed roller and the driven roller thereof in the constant speed section under feedback control.

4. A printer-control apparatus comprising a feedback control component which changes a proportional gain coefficient used for speed control calculation to a value which is larger than an usual value when a difference between a target speed and a current speed in a constant speed section under feedback control becomes equal to or larger than a predetermined value in speed control for the paper-supply motor from the time when a paper-supply roller starts a paper-supply operation to the time when an upper end of a printing paper abuts against a paper-feed roller and a driven roller thereof and then the paper-supply motor is stopped with an upper end portion of the printing paper being nipped by the paper-feed roller and the driven roller thereof.

5. The printer-control apparatus according to claim 4, wherein said feedback control component can perform control for changing said proportional gain coefficient on the condition that a nipping amount of the printing paper with respect to the paper-feed roller and the driven roller thereof at a target stop position at which said paper-supply motor is stopped with the upper end portion of the printing paper being nipped by the paper-feed roller and the driven roller thereof is set to be equal to or larger than a predetermined value.

6. The printer-control apparatus according to claim 5, wherein said predetermined value of said nipping amount is a minimum value of said nipping amount in the case where the printing paper abuts against the paper-feed roller and the driven roller thereof in the constant speed section under feedback control.

7. A storage medium for computer program in which a computer program for executing, in a computer system, a printer-control method for changing a proportional gain coefficient used for speed control calculation to a value which is larger than an usual value when a difference between a target speed and a current speed in a constant speed section under feedback control becomes equal to or larger than a predetermined value in speed control for the paper-supply motor from the time when a paper-supply roller starts a paper-supply operation to the time when an upper end of a printing paper abuts against a paper-feed roller and a driven roller thereof and then the paper-supply motor is stopped with the upper end of the printing paper being nipped by the paper-feed roller and the driven roller thereof is recorded.

* * * * *